US005906100A

United States Patent [19]

Caldwell et al.

[11] Patent Number: 5,906,100

[45] Date of Patent: May 25, 1999

[54] DEWAR FOR STORING AND DELIVERING LIQUID CRYOGEN

[75] Inventors: Bruce D. Caldwell, Morgan City, La.; Paul D. Duncan, Matthews, N.C.; John H. Fricker, Seabrook, Tex.; Charles L. Hethcoat, III, Houston, Tex.; Rick C. Hunter, Friendswood, Tex.; Paul E. Robinson, Houston, Tex.

[73] Assignee: Oceaneering International Inc., Houston, Tex.

[21] Appl. No.: 08/843,388

[22] Filed: Apr. 15, 1997

Related U.S. Application Data

[63] Continuation-in-part of application No. 08/512,363, Aug. 8, 1995, Pat. No. 5,619,857, which is a continuation-in-part of application No. 07/957,599, Oct. 6, 1992, Pat. No. 5,438,837.

[51] Int. Cl.[6] ..... F17C 7/02

[52] U.S. Cl. ..... 62/50.1; 62/48.1

[58] Field of Search ..... 62/50.1, 48.1

[56] References Cited

U.S. PATENT DOCUMENTS

| | | | |
|---|---|---|---|
| 2,415,972 | 2/1947 | Stinson . | |
| 2,446,612 | 8/1948 | Sauser et al. . | |
| 2,740,563 | 4/1956 | Jackson . | |
| 2,835,263 | 5/1958 | Klank, Jr. . | |
| 2,945,354 | 7/1960 | Moskowitz . | |
| 2,990,695 | 7/1961 | Leffingwell, Jr. . | |
| 3,064,448 | 11/1962 | Whittington . | |
| 3,117,426 | 1/1964 | Fischer et al. . | |
| 3,227,208 | 1/1966 | Potter, Jr. et al. . | |
| 3,263,433 | 8/1966 | Fitt . | |
| 3,343,536 | 9/1967 | Brisson et al. . | |
| 3,345,614 | 10/1967 | Jennings et al . | |
| 3,570,481 | 3/1971 | Woodberry, Jr. . | |
| 3,572,048 | 3/1971 | Murphy . | |
| 3,635,216 | 1/1972 | Curtis . | |
| 3,648,289 | 3/1972 | Moreland . | |
| 3,730,178 | 5/1973 | Moreland . | |
| 3,807,396 | 4/1974 | Fischel . | |
| 3,831,594 | 8/1974 | Rein . | |
| 3,898,853 | 8/1975 | Iung | 62/50.1 |
| 3,925,048 | 12/1975 | Iung | 62/50.1 |
| 3,941,124 | 3/1976 | Rodewald et al. . | |
| 4,024,730 | 5/1977 | Bell et al. . | |
| 4,133,376 | 1/1979 | Eilenberg et al. . | |
| 4,172,454 | 10/1979 | Warncke et al. . | |
| 4,181,126 | 1/1980 | Hendry . | |
| 4,203,458 | 5/1980 | Barrett et al. . | |
| 4,211,086 | 7/1980 | Leonard et al. . | |
| 4,286,439 | 9/1981 | Pasternack . | |
| 4,339,927 | 7/1982 | Sarcia . | |
| 4,425,764 | 1/1984 | Lam et al. . | |
| 4,459,822 | 7/1984 | Pasternack et al. . | |

(List continued on next page.)

FOREIGN PATENT DOCUMENTS

| | | |
|---|---|---|
| 1154397 | 10/1957 | France . |
| 1366113 | 6/1964 | France . |
| 414107 | 5/1925 | Germany . |
| 2060863 | 5/1981 | United Kingdom . |

OTHER PUBLICATIONS

H.E. Agen et al., A Liquid Air Device For Cooling The Wearer of a Totally Enclosed Liquid Rocket Propellant Handler's Suit, H.E. Agen et al., pp. 196–202.

Perry et al., Chemical Engineer's Handbook, Fifth Edition, Graw–Hill Book Company, 17 pages, (1973).

*Primary Examiner*—Ronald Capossela

*Attorney, Agent, or Firm*—Marvin B. Eickenroht; Kurt S. Myers

[57] ABSTRACT

There are disclosed several embodiments of dewars each of which include an insulated apparatus for storing and delivering a liquid cryogen and a capacitance gauge for measuring the liquid level of cryogen. A process for rapidly filling the vessel with cryogen is also disclosed.

37 Claims, 15 Drawing Sheets

U.S. PATENT DOCUMENTS 4,459,823 7/1984 Josephs et al. .
4,489,569 12/1984 Sitte .
4,580,411 4/1986 Orfitelli .
4,674,289 6/1987 Adonian .
4,727,255 2/1988 Monier et al. .
4,744,222 5/1988 Monier .
4,783,853 11/1988 Zuber .
4,838,270 6/1989 Donnerhack et al. .
4,854,128 8/1989 Zeamer .
4,951,660 8/1990 Lubitzsch .
5,357,758 10/1994 Andonian .
5,511,542 4/1996 Hall .
5,582,016 12/1996 Gier et al. .

FIG.1A
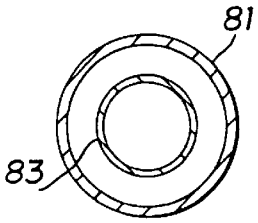
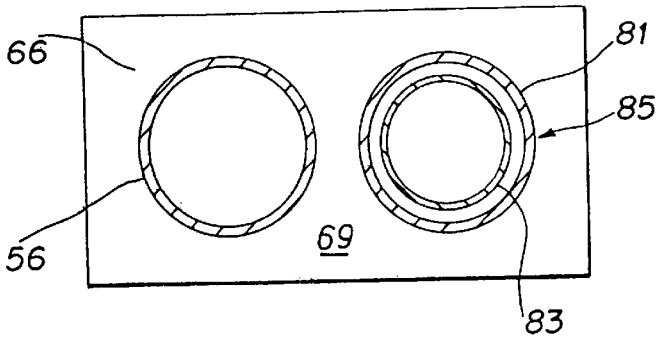
FIG.2A
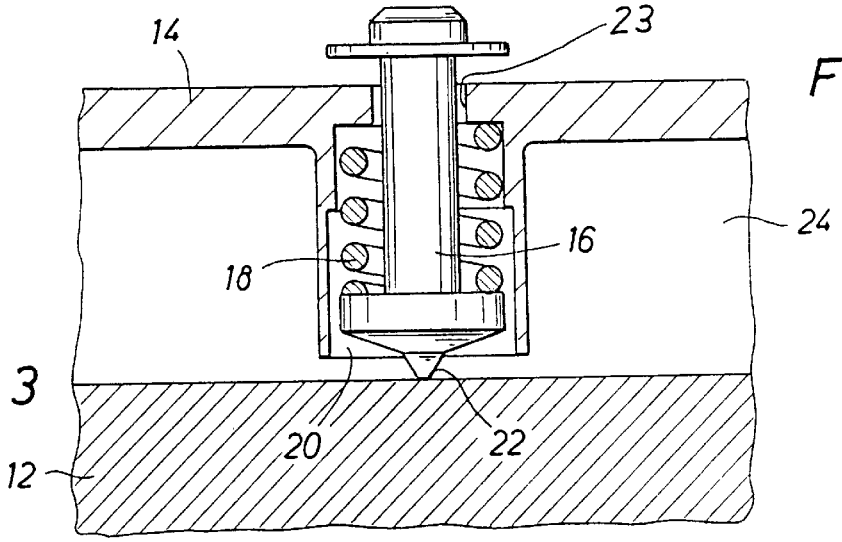
FIG.3
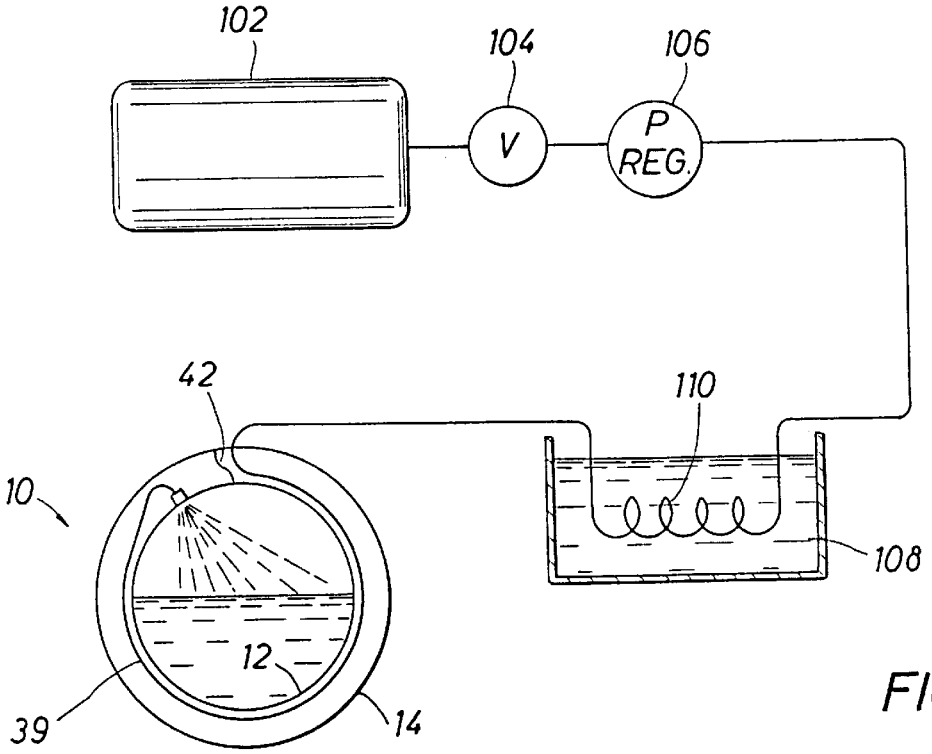
FIG.19

129'
143B'
AA
142'
145B
216B
218B
210B
124'
76'
50'
52''
32''
236
124F'
54F
48''
44F
17
81
34''
214
212
49''
46'
74'
216A
218A
210A
143A'
145A

DEWAR FOR STORING AND DELIVERING LIQUID CRYOGEN

This application is a continuation-in-part of application Ser. No. 08/512,363, filed Aug. 8, 1995, now U.S. Pat. No. 5,619,857, which was in turn, a continuation-in-part of Ser. No. 07/957,599 filed Oct. 6, 1992, now U.S. Pat. No. 5,438,837.

BACKGROUND OF THE INVENTION

1. Field of the Invention

This invention pertains to the application of cryogenic technology to life support systems and, more particularly, in one of its aspects to an insulated pressure vessel, such as a dewar, for storing and delivering a cryogenic fluid. In another of its aspects, it refers to an improved process for rapidly filling the dewar with a cryogenic fluid.

2. Description of the Prior Art

"Cryogenic" is a term used to describe physical conditions at temperatures less than approximately 123K (−151° C., −239° F.). A "cryogenic fluid" may be defined as a fluid whose temperature is less than approximately 123K (−151° C., −239° F.) that boils at temperatures less than approximately 110K (−262° F., −163° C.) at atmospheric pressure, and a cryogenic fluid may therefore be either a gas or a liquid. Although these definitions are adequate for many applications, the terms are capable of many definitions and the use of the terms herein should be construed consistently with the many definitions accepted by those in the art. Examples of cryogenic fluids include both nitrogen and oxygen, the primary components of "liquid air". The term "cryogen" as used herein shall refer to a cryogenic fluid and the term "cryogenic technology" shall refer to knowledge, techniques, and equipment for harnessing physical properties of cryogenic fluids to practical applications.

A wide variety of diverse fields employ cryogenic technology, and portable life support systems are experiencing a resurgent interest in cryogenic technology. Many portable life support systems store liquid cryogen in a vacuum insulated pressure vessel called a dewar from which liquid cryogen is delivered to other parts of the life support system. One such system is disclosed and claimed in U.S. Pat. No. 5,361,591 issued Nov. 8, 1994 to Oceaneering International, Inc. as assignee of the inventor Bruce D. Caldwell. An inner pressure vessel is typically jacketed by an insulative housing, the space between the pressure vessel and the insulative housing being evacuated and sometimes filled with multi-layered insulation or reflective powders.

Any dewar in a portable life support system employing cryogenic fluids will contain gas and, if filled, liquid cryogen. With the exception of portable life support systems used in micro-gravity or zero-gravity environments, most portable life support system dewars rely on gravity to separate liquid cryogen from gaseous cryogen. Gravity separation is advantageous because the cryogenic fluid can be pressurized to provide a motive force in delivering the liquid cryogen from the dewar. One may therefore take advantage of the natural properties of the cryogen to deliver the liquid from the dewar by pressurizing the separated gas within the dewar's pressure vessel.

Some current efforts at portable life support system design such as that disclosed in the '591 Caldwell patent focus on using liquid cryogen as part of a cooling loop regulating the user's body temperature. Heat exchange in such a cooling loop cools the user through an intermediate cooling loop while warming the liquid cryogen, generally converting the liquid cryogen to gas. If the liquid cryogen is "liquid air", a breathing air supply is provided for the system's user by the vaporization of the cryogen.

This type of portable life support system requires an uninterrupted flow of liquid cryogen from the dewar and the ability to gauge the dewar's cryogen content. Additionally, liquid withdrawal is necessary to (1) control the pressure of the dewar contents, (2) utilize the phase change from liquid to gas that provides one-half the cooling capacity of the system, and (3) deliver a consistent component mixture for the air in the breathing air supply. Thus, gravity separation can be very advantageous.

The drawback to gravity separation is that the liquid cryogen's position shifts within the dewar when the orientation of the dewar is changed with respect to gravity. The dewar for a portable life support system is usually worn on the back of the system user and, whenever the user bends at the waist, the orientation of the dewar with respect to gravity changes. Such changes in orientation can also occur by body movements other than those at the waist. These changes can occur in one, or both, planes of movement: (1) forward and back, and (2) side to side.

The shift in position by the dewar's liquid contents can expose a typically fixed intake port through which liquid cryogen is delivered in a standard upright dewar to the gaseous cryogen in the dewar. When the port is exposed, the pressurized gaseous cryogen escapes through the port. This depressurizes the dewar, eliminates the motive force and thereby interrupts the delivery of liquid cryogen. For instance, if someone wearing a portable life support system stoops or bends over as if to lift something, the intake port may become exposed and allow the pressurized gas to escape and interrupt the liquid cryogen's delivery until the port is once again immersed in the liquid cryogen and pressure is restored to the dewar.

The positional shift of the dewar's contents also causes problems in ascertaining the volume of liquid cryogen remaining in a standard upright dewar. Because it is desirable to fully utilize the contents of the dewar and, more importantly, to provide the user at all times with an accurate determination of the remaining cryogen in the dewar, i.e., the dewar capacity, an accurate determination of liquid cryogen levels in the dewar must be available at virtually all times. Furthermore, reliability in the cryogen capacity is entirely dependent on the dewar's ability to provide for complete withdrawal of the cryogen stored therein. Complete utilization of the dewar contents further permits for a reduction in the overall weight of the dewar because there is no need for a safety margin in the cryogen to accommodate inaccurate gauging. The reduction in weight further results on increased capacity because the user's metabolic rate, and thus his/her cryogen consumption rate, is reduced under the lighter load. Thus, for example, a fireman entering a burning building obviously needs to know how much liquid cryogen is available in the dewar for cooling and/or breathing purposes, since the liquid quantity can be equated to a capacity or duration time for the user to monitor.

Current techniques employ a capacitance gauge fixed in a gravity vector in the dewar which distinguishes gas from liquid by their differing dielectric constants. The capacitance of the gauge varies with the level of liquid, so the shifting of liquid cryogen within the dewar caused by user movement also prohibits accurate determination of liquid cryogen levels in the dewar.

It is an object of this invention to provide an apparatus for the delivery of a liquid cryogenic fluid without interruption resulting from changes in orientation of the apparatus with regard to gravity or other external acceleration forces.

It is a further object of this invention to provide means for completely withdrawing the liquid cryogen from such an apparatus, especially during changes in orientation relative to gravity.

It is a further object to provide a capacitance gauge that accurately measures the quantity of liquid cryogen in the vessel regardless of the vessel's orientation.

It is a further object to provide an apparatus containing an insulated vessel for storing the liquid cryogen that is structurally independent.

It is a further object to provide such a vessel having a shape that maximizes its structural integrity while preserving its useful volume for storing liquid cryogen.

It is a further object to provide such an insulated vessel that requires no substantial supplemental structural support members, and as a result is easier to manufacture and exhibits a reduced weight, whereby the weight of the overall apparatus is reduced and the physical stress imposed on the user is also reduced.

It is a further object to provide such an apparatus having a minimum of sealed surfaces, particularly sealed rotary joints, so that leakage of the liquid cryogen is minimized and a liquid intake means in the apparatus can move freely under reduced friction to follow the liquid cryogen as the liquid moves within the vessel under an external force such as gravity.

It is a further object that the intake means have a minimum of relatively moving components to further reduce friction so that the intake means can freely follow the liquid cryogen and the weight of the apparatus is reduced.

It is a further object that the apparatus include an offset means, referred to as a "kicker," in the vessel for ensuring that the intake means quickly reacts to follow the liquid cryogen within the vessel as the liquid is moved by orientation of the apparatus relative to the gravity vector.

It is a further object that the insulated vessel be mounted within the apparatus in a manner that minimizes the amount of heat transferred through the apparatus to the vessel.

It is a further object to provide means for rapidly filling the vessel with liquid cryogen in a highly efficient manner.

SUMMARY OF THE INVENTION

These and other objects are accomplished in accordance with one or more embodiments of this invention, by an apparatus that includes an insulated vessel having spaced end walls and a side wall extending between the end walls. The side wall is shaped to define a circle within a plane perpendicular to a first axis of the vessel and is arcuate about a second axis of the vessel lying in the plane. First means are provided for supplying and delivering liquid cryogen to and from the vessel including a first conduit mounted in the vessel for rotation about the first and second axes and being of such length that its open end closely circumscribes the inner surface of the side wall and sweeps closely past the arcuate inner surface of the side wall from one end wall to the other, as the orientation of the vessel changes. Second means are further provided through which a gas may be supplied to or exhausted from the vessel above the level of the liquid cryogen. Means connect the first conduit with the exterior of the vessel to complete the transfer of liquid cryogen to or from the vessel via the first conduit in different orientational positions of the vessel.

In a preferred embodiment, the apparatus further includes kicker means for offsetting the center of mass of a pivotal assembly including the first conduit to prevent the assembly from achieving a semi-stable position that inhibits the ability of the first conduit to follow the liquid cryogen about the vessel. The kicker includes a pair of arms mounted for rotation with the first conduit and disposed generally within the first plane. A first of the arms extends generally radially from the first axis along the second axis, and a second of the arms extends diagonally from near the side wall of the vessel to intersect at an outer end of the second arm with an outer end of the first arm. A weight slides along the second arm from an inner end thereof toward its outer end in response an external force acting on the apparatus to induce rotation of the first conduit about the first and second axes whereby the open end of the first conduit follows the liquid cryogen in the vessel. The preferred embodiment further includes a capacitance gauge for measuring the liquid cryogen content within the vessel mounted for rotation about the first axis, and which includes first and second electrically conductive plates each having outer edges conforming with the inner surfaces of the vessel. The plates are electrically isolated from one another but fastened to one another so as to maintain a small gap between the plates, and electrical leads communicate an electrical signal from at least one of the plates to the exterior of the vessel that is indicative of the liquid cryogen content within the vessel.

In accordance with another novel aspect of the invention the vessel is of optimum strength by virtue of a pair of reinforcing rings respectively positioned about its circular edges formed at the intersection of the end walls with the side wall for bearing hoop stresses resulting from pressure differential forces applied across the vessel.

Another aspect of the present invention provides a system for rapidly filling the vessel with liquid cryogen which includes a source of pressurized gas regulated to a pressure below supercritical pressure, means for cooling the gas to a subcritical temperature at the subcritical pressure to obtain a cryogenic fluid, and means for delivering the cryogenic fluid to the vessel. Thus, there is no need for an expansion valve on the vessel to condense the cryogen, as described in U.S. Pat. No. 5,438,837, since it is already a true liquid when introduced to the vessel.

BRIEF DESCRIPTION OF THE DRAWINGS

A more particular description of the invention briefly summarized above can be had by reference to the preferred embodiments illustrated in the drawings in this specification so that the manner in which the above cited features, as well as others that will become apparent, are obtained and can be understood in detail. The drawings illustrate only preferred embodiments of the invention and are not to be considered limiting of its scope as the invention will admit to other equally effective embodiments. In the drawings:

FIG. 1A is a cross-sectional view of the capacitance gauge of the dewar shown in FIG. 1 along line 1A—1A therein;

FIG. 2A is a cross-sectional view of the liquid cryogen pickup and the capacitance gauge along line 2A—2A of FIG. 2;

FIG. 3 is an enlarged illustration of part of a system suspending the insulated pressure vessel within the insulative housing of the first embodiment of the dewar;

FIG. 19 is a diagrammatical view, partly in section, illustrating the improved process for rapidly filling the dewar with liquid cryogen.

DESCRIPTION OF THE PREFERRED EMBODIMENTS

Figure 1:
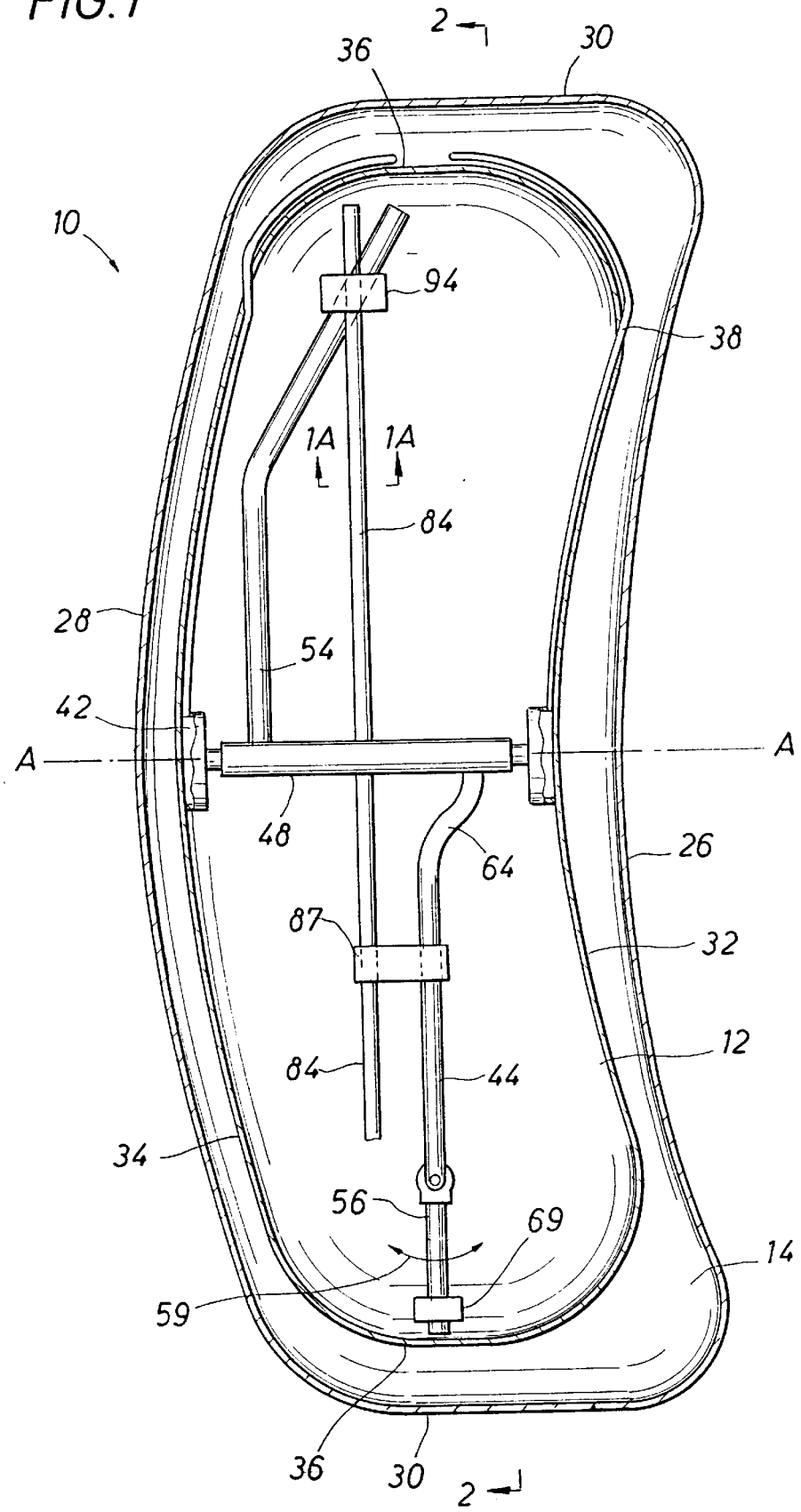
FIG. 1 is a sectional view of the dewar in a first embodiment along line 1—1 of FIG. 2.

The dewar, in a first embodiment illustrated in FIGS. 1–5 and generally denoted 10, includes pressure vessel 12 mounted within insulative housing 14 as best shown in FIG. 1. Dewar 10 in the preferred embodiment is intended for use in a portable life support system such as that described in the '591 Caldwell patent discussed above as a "self-pressurizing dewar", i.e., gas produced by the system vaporization of liquid cryogen is used to pressurize the contents of pressure vessel 12. However, other external means of pressurization may be used as may be apparent to those skilled in the art. For instance, several acceptable alternatives are disclosed in the '591 Caldwell patent.

Pressure vessel 12 is mounted within insulative housing 14 in a manner minimizing heat transfer from insulative housing 14 to pressure vessel 12. In one embodiment, pressure vessel 12 is mounted using a suspension system comprising a plurality of "point contacts" such as that shown in FIG. 3. Each suspension point of the point contact suspension system generally comprises reciprocable suspension member 16 biased inwardly by return spring 18 within recess 20. The reciprocal movement of suspension member 16 compensates for changes in dimension of pressure vessel 12 and insulative housing 14 caused by fluctuations in temperature and pressure. Contact 22 of suspension member 16 is essentially a point to minimize surface contact and therefore conductive heat transfer from insulative housing 14 to pressure vessel 12.

The point contact suspension system of FIG. 3 is not the only method by which pressure vessel 12 may be mounted within insulative housing 14. Many methods of suspension are known and used in the construction of dewars. Examples include straps and webbing, and any of these alternatives may be acceptable in accordance with the goal of minimizing conductive heat transfer. Alternative suspension systems are discussed below in connection with the dewar embodiments of FIGS. 6–9 and FIGS. 10–18. Insulative housing 14 is not required in all embodiments of the invention, and the method of suspending pressure vessel 12 therein is not a consideration in such embodiments. For instance, the Earth's moon is a gravity rich environment but has no atmosphere such that pressure vessel 12 as further described herein would be vacuum insulated without insulative housing 14.

Figure 2:
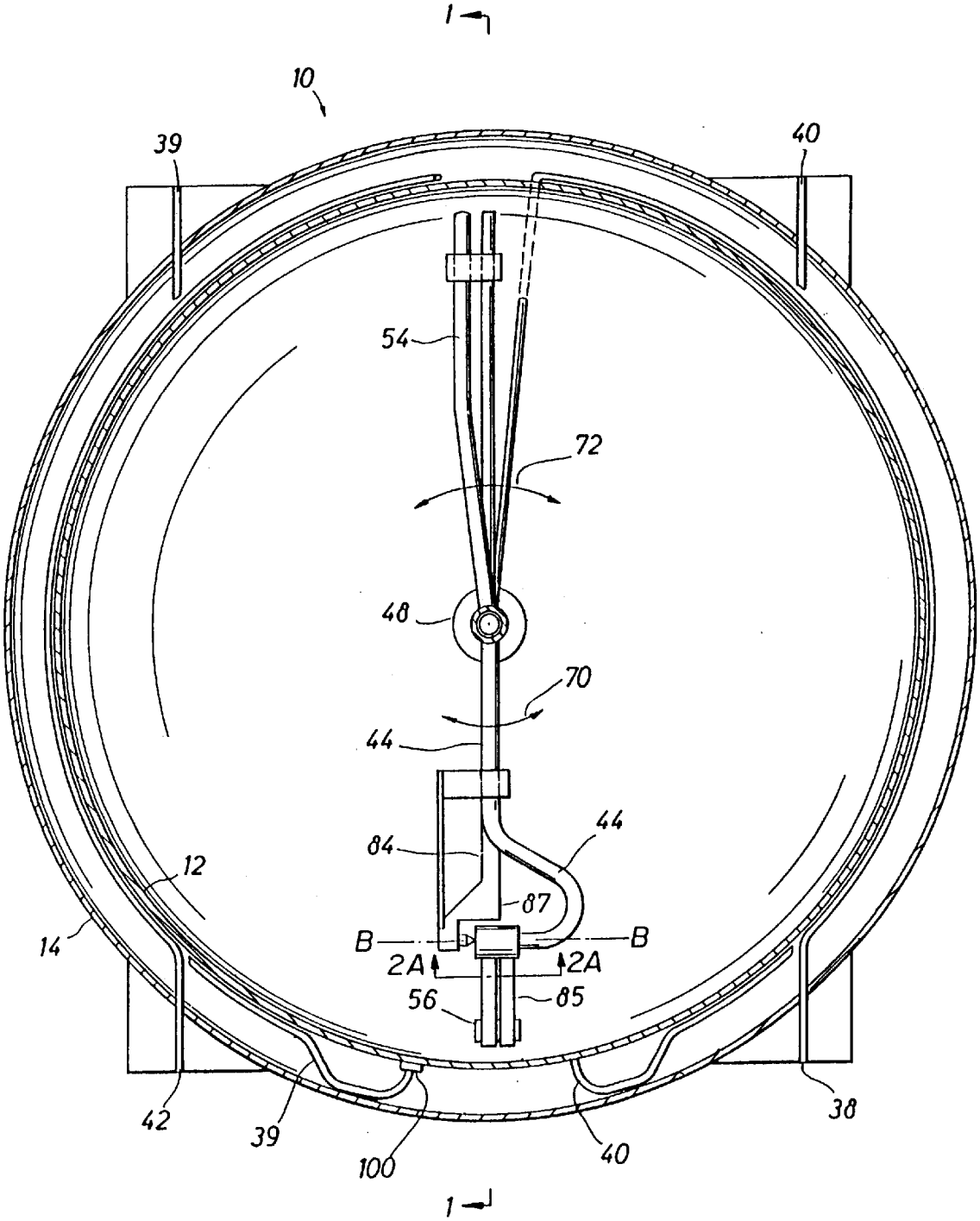
FIG. 2 is a cross-sectional view of the dewar taken along line 2—2 of FIG. 1.

With reference now to FIG. 2, additional insulation for dewar 10 can be obtained by properly using space 24 between pressure vessel 12 and insulative housing 14. However, the point-contact suspension system of FIG. 3 is not conducive to the provision of additional insulation due to bores 23 that would prohibit the use of a vacuum or other packing means. Thus, assuming alternative suspension methods are employed, a vacuum may be drawn in space 24 between pressure vessel 12 and insulative housing 14 and space 24 may be filled with multi-layer insulation or reflective powders as is known in the industry. Other methods such as filling space 24 with insulative foams such as polyurethane or Aerogel may be equally acceptable. The inner and outer walls of pressure vessel 12 and/or insulative housing 14 may furthermore be metal-plated to reflect heat and thereby minimize radiative heat transfer between pressure vessel 12 and insulative housing 14.

FIGS. 1 and 2 best illustrate the profiles of pressure vessel 12 and insulative housing 14 and, hence, dewar 10 as a whole. Insulative housing 14 is comprised of spaced first end wall 26 and second end wall 28, both of which are preferably substantially circular in shape, joined at their outer edges by side wall 30. Pressure vessel 12 is likewise comprised of first end wall 32 and second end wall 34, each of which are also preferably substantially circular in shape, joined at their outer edges to form side wall 36. Side wall 36 is preferably of generally cylindrical shape and thus defines a circle which is within a plane perpendicular to a first axis A—A of the vessel, since, as will be described, this greatly facilitates the delivery of liquid cryogen by the rotating intake. However, side wall 36 also joins with end walls 32 and 34 in an arcuate assembly, as displayed in FIG. 1.

Dewar 10 is intended to be mounted on the back of a portable life support system user as a "backpack" unit, and it is therefore desirable that the dewar exhibit a flat, low profile. In other words, the thickness of the backpack, as viewed from the user's side (not shown), must be minimized so as not to substantially offset the user's center of gravity or to inhibit the user's ability to enter and exit confined spaces. First walls 26 and 32 therefore have concave-shaped outer surfaces to fit snugly against the back of the user, and second walls 28 and 34 have complementing convex-shaped outer surfaces.

For a given volume of gas or liquid in a dewar, a sphere is the optimum pressure vessel choice for minimizing system weight. However, a sphere is a particularly poor choice for minimizing thickness. This fact has traditionally led to the use of cylindrical pressure vessels wherein the length of the longitudinal axis is significantly greater than the diameter of the vessel. In each of the embodiments described herein, the longitudinal axis of the pressure vessel that houses the cryogen is significantly shorter than the diameter of the vessel. This innovative approach provides a substantial reduction in the thickness of the user backpack while optimizing the cryogenic storage volume, given the physical limitations of a user's back area. The present invention thus embodies a geometry that provides the lightest weight and lowest profile to date for a self contained breathing apparatus according to a given duration rating.

To this extent, the use for which dewar 10 is intended also affects the profile of pressure vessel 12 and insulative housing 14 and any combination of convex and concave shapes may be suitable or even desirable depending upon the particular application to which dewar 10 might be put.

The liquid cryogen supply and delivery means of dewar 10 comprises enclosed channel 38 and fill lines 39–40. Each of fill lines 39–40 begins external to insulative housing 14, passes through the wall thereof into space 24, and is sealably joined to apertures in the wall of pressure vessel 12, as best shown in FIG. 2. Enclosed channel 38, as shown in FIG. 2, begins external to insulative housing 14, passes through the wall thereof into space 24, through space 24 and through the wall of pressure vessel 12 and, as shown in FIG. 1, to central hub 48. The functions of fill lines 39–40 and enclosed channel 38 may be combined in some embodiments to produce a single fluid flow line. Fill lines 39 and 40 can be used with filling processes known to those of ordinary skill in the art, as well as a preferred rapid fill process described below.

The gas supplying and venting means is generally comprised of enclosed channel 42. Enclosed channel 42, as shown in FIG. 2, begins external to insulative housing 14, passes through the wall thereof into space 24 and, as shown in FIG. 1, through the wall of pressure vessel 12 to central hub 48. The supplying and venting functions of enclosed channel 42 may be performed by separate lines but preferably does not do so because rapid fill is not limited by gas venting and the combination of functions reduces the number of structural elements. In some embodiments, enclosed channel 42, as well as enclosed channel 38, may be fluid flow lines, such as fill lines 39–40, sealably joined to apertures in the wall of pressure vessel 12 so as to be fluidly connected to chambers 46 and 50 within hub 48 by means of perforated tubes 74 and 76 as shown in FIG. 5.

Figure 4:
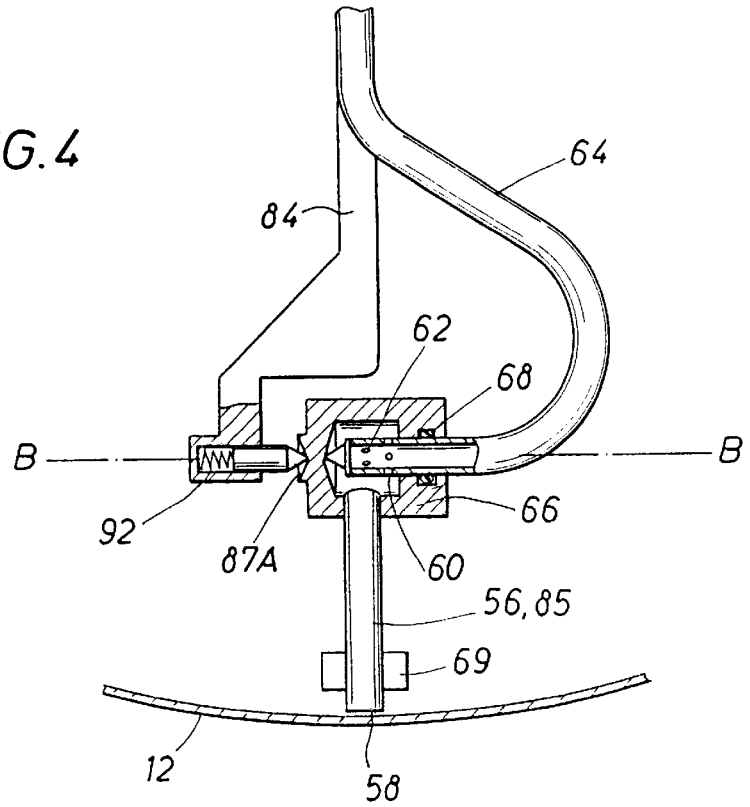
FIG. 4 is an enlargement of the liquid cryogen intake of the first embodiment.
Figure 5:
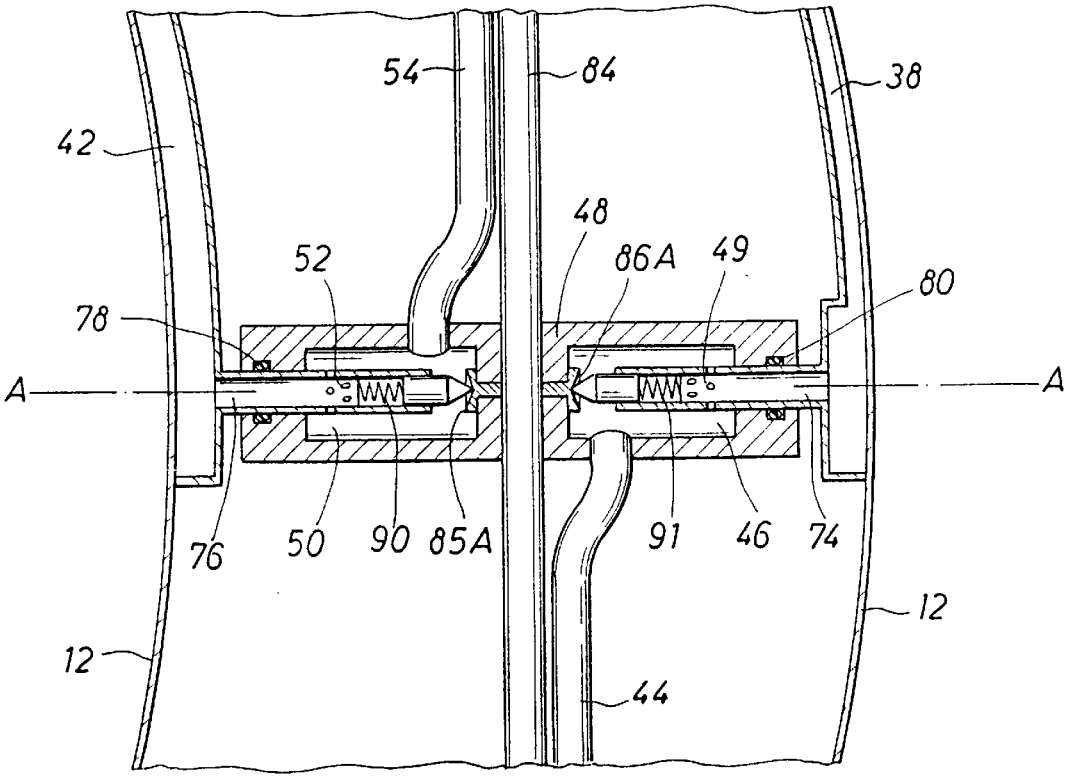
FIG. 5 is an enlargement of the rotating central hub to which the liquid cryogen intake and the gas supply/vent member of the first embodiment are affixed.

Dewar 10 also includes liquid cryogen intake member 44 in the form of a first conduit, and ullage or gas member 54 in the form of a second conduit shown in FIGS. 1–2 and 4, both of which are mounted on the hub to rotate with it about axis A—A as shown in FIGS. 1 and 5 through a full 360° as further illustrated by arrows 70 and 72, respectively, in FIG. 2. As best shown in FIG. 5, the liquid cryogen supplying and delivering means, includes intake member 44 and ullage member 54 which are fixedly attached to central hub 48 and sealably joined to apertures therein to fluidly connect intake member 44 and ullage member 54 with chambers 46 and 50, respectively. Central hub 48 is sealably and rotatably mounted to perforated tubes 74 and 76 of enclosed channels 38 and 42, whose function is described below, formed within walls 32 and 34 of pressure vessel 12. Liquid cryogen enters enclosed channel 38 from chamber 46 through perforations 49 formed in tube 74, and is then delivered from dewar 10 via enclosed channel 38. Chambers 46 and 50 are preferably sealed at the point of rotation by seals 80 and 78 held in place by snap rings. Intake member 44 is sufficiently long so that its outer open end extends nearly the full radius of pressure vessel 12 close to side wall 36 and therefore circumscribes side wall 36 as it rotates about axis A—A.

Ullage member or second conduit 54 is fluidly connected to enclosed channel 42 of the gas supply and delivery means as best shown in FIG. 5 such that gas may be supplied to and vented from the ullage of pressure vessel 12. Gas flows through conduit 54 to chamber 50 of central hub 48, through perforations 52 in tube 76 to enclosed channel 42, and out from enclosed channel 42 to vent gas. The process of supplying gas via ullage member 54 is simply reversed from that of venting. Ullage member 54, like intake member 44, is sufficiently long to extend nearly the full radius of pressure vessel 12 near end wall 36 and therefore circumscribes side wall 36 as it rotates about first axis A—A. However, the open end of conduit 54 stops short of end wall 36 so as to define the level at which the vessel is "full" of liquid cryogen during the fill process, as described further below with regard to the preferred embodiment of the present invention.

Intake member or first conduit 44 consists of an inner member 64 mounted on hub 48 and outer member 56 in which the open end of the conduit is formed. As best shown in FIG. 4, outer member 56 is fixedly connected to hub 66 which in turn is mounted about the end of members 64 for rotation about second axis B—B which extends within the plane perpendicular to axis A—A. Chamber 60 within hub 66 is sealed at the point of rotation by seal 68 which is held in place by a snap ring to maintain integrity of the fluid flow channel between members 56 and 64. For delivery purposes, liquid cryogen is drawn into chamber 60 of hub 66 through outer member 56, and then passes through perforations 62 into inner member 64.

Weight 69 is fixedly mounted to member 56 near intake end 58 to ensure that outer member 56 rotates about axis B—B in response to an external force such as gravity. Weight 69 also ensures rotation of first conduit 44 as a whole, as well as second conduit 54 about axis A—A in response to the external force. However, the weight and length of first conduit 44 may be sufficient in some embodiments to eliminate the need for weight 69.

Outer member 56 of first conduit 44 thus rotates about axis B—B shown in FIGS. 2 and 4 in a 180° arc illustrated by arrows 59 in FIG. 1. Through rotation of member 56 about axis B—B, the outer open end of first conduit 44 sweeps side wall 36 as it rotates with hub 48 to circumscribe the side wall about axis A—A. The rotation of conduit 44 about both axis A—A and axis B—B in response to gravity or other forces induces outer member 56 to follow the liquid cryogen as it moves under the external force about the dewar so that open end 58 remains immersed in the liquid cryogen. In this manner, dewar 10 provides for complete or substantially complete withdrawal of the liquid cryogen according to user demand, whereby the user is assured of a predictable, consistent, and reliable source of cryogen for breathing and/or cooling purposes.

Since second conduit 54 also rotates as does inner member 64 of first conduit 44, its open outer end generally remains in the ullage of pressure vessel 12 and out of the liquid. Because the outer end is above the liquid, gas introduced to the vessel will not be "bubbled through" the liquid cryogen. This is essential for optimum use of the cryogen contents because the bubbling of gas through the liquid can upset the oxygen/nitrogen balance within the vessel and thus the consistency of the vaporized cryogen delivered for breathing.

As indicated previously, gas of some sort is generally supplied to the ullage of pressure vessel 12 in order to pressurize the liquid. However, gas pressure buildup during filling may be sufficient to pressurize the liquid and may even need to be vented to maintain operational levels. Either way, gravity will operate to separate the liquid from the gas because of their differing specific gravities, the heavier liquid being layered on the "bottom" of the dewar "beneath" the gas.

Because both first and second conduits 44 and 54 are connected to central hub 48, conduit 54 rotates as conduit 44 rotates in response to gravity or other forces. Furthermore, since members 54 and 44 extend from central hub 48 in opposite directions, member 54 rotates in response to external forces to preferably remain at least partially emergent from the liquid cryogen. However, in some embodiments this factor may not be a consideration and a conventional, non-rotating and even flexible gas supply/vent may be used in place of conduit 54. As long as intake 58 remains immersed in the liquid cryogen, there is no interruption of liquid cryogen delivery and the contents of dewar 10 are not depressurized as a result of a change in the orientation of dewar 10 with respect to gravity.

Dewar 10 also contains gauge 84 by which the liquid cryogen contents of the dewar may be measured. The relationship of gauge 84 to the other components of dewar 10 previously discussed is best illustrated in FIGS. 1–2. Thus, gauge 84 is a capacitance gauge, whose measured capacitance is proportional to the depth of the liquid in which it operates and which distinguishes liquid cryogen from gas cryogen by their different dielectric properties. As shown in FIGS. 1A and 2A, capacitance gauge 84 comprises outer shell 81 and concentric inner tube 83.

As shown, gauge 84 is affixed to second conduit 54 on one end by clamp 94 (FIGS. 1 and 2) and is affixed to first conduit 44 by a clamp or bracket 87 (FIG. 2) on the other end, so gauge 84 rotates in response to gravity or other external forces as do conduits 54 and 44 about axis of rotation A—A to ensure that the open end 85 of gauge 84 remains immersed in the liquid cryogen. Capacitance gauge 84 thus comprises end piece 85 which, as shown in FIGS. 2 and 4, rotates about axis B—B with outer member 56 of first conduit 44 to sweep as well as circumscribe side wall 36. As previously described, end piece 85 of the gauge comprises outer shell 81 and tubular, concentric, inner plate 83. The outer shell 81 of end piece 85 must be wired to outer shell 81 of main piece 84 and inner plate 83 of end piece 85 must be wired to inner plate 83 of main piece 84 to electrically connect the gauge sections.

The capacitance measured by gauge 84 is monitored via electrical contacts 85A–86A shown in FIG. 5 and electrical contact 87A shown in FIG. 4, through electrical leads (not shown) routed through conduit 44 and enclosed channel 38, and enclosed channel 42. One of outer shell 81 and inner plate 83 of gauge 84 is wired to contact 85A and the other to contact 86A to complete the electrical circuit. One of outer shell 81 and inner plate 83 of end piece 85 of gauge 84 is wired to an electrical contact not shown and the other grounded to pressure vessel 12 in any suitable manner known to the art.

Alternatively, one of electrical contacts 85A–86A can be grounded to pressure vessel 12 to eliminate one such lead. Furthermore, the electrical contact may be replaced with two simple leads, one each to the inner plate 83 and outer shell 81 of end piece 85. Springs 90–92 (FIGS. 4 and 5) provide temperature compensation by maintaining the electrical contacts at 85A–87A as dimensions of the structural elements change in response to fluctuations in temperature and pressure.

An alternative dewar embodiment 10' is illustrated in FIGS. 6–9, with parts like those illustrated in FIGS. 1–2 and 4–5 bearing like numbers to dewar 10. As shown best in FIGS. 6–7, insulative housing 14' comprises first end wall 26', second end wall 28', and side wall 30'. Insulative housing 14', like insulative housing 14 in FIGS. 1–5, is preferably constructed of titanium or some other sturdy, suitable material as will be apparent to those in the art.

Figure 6:
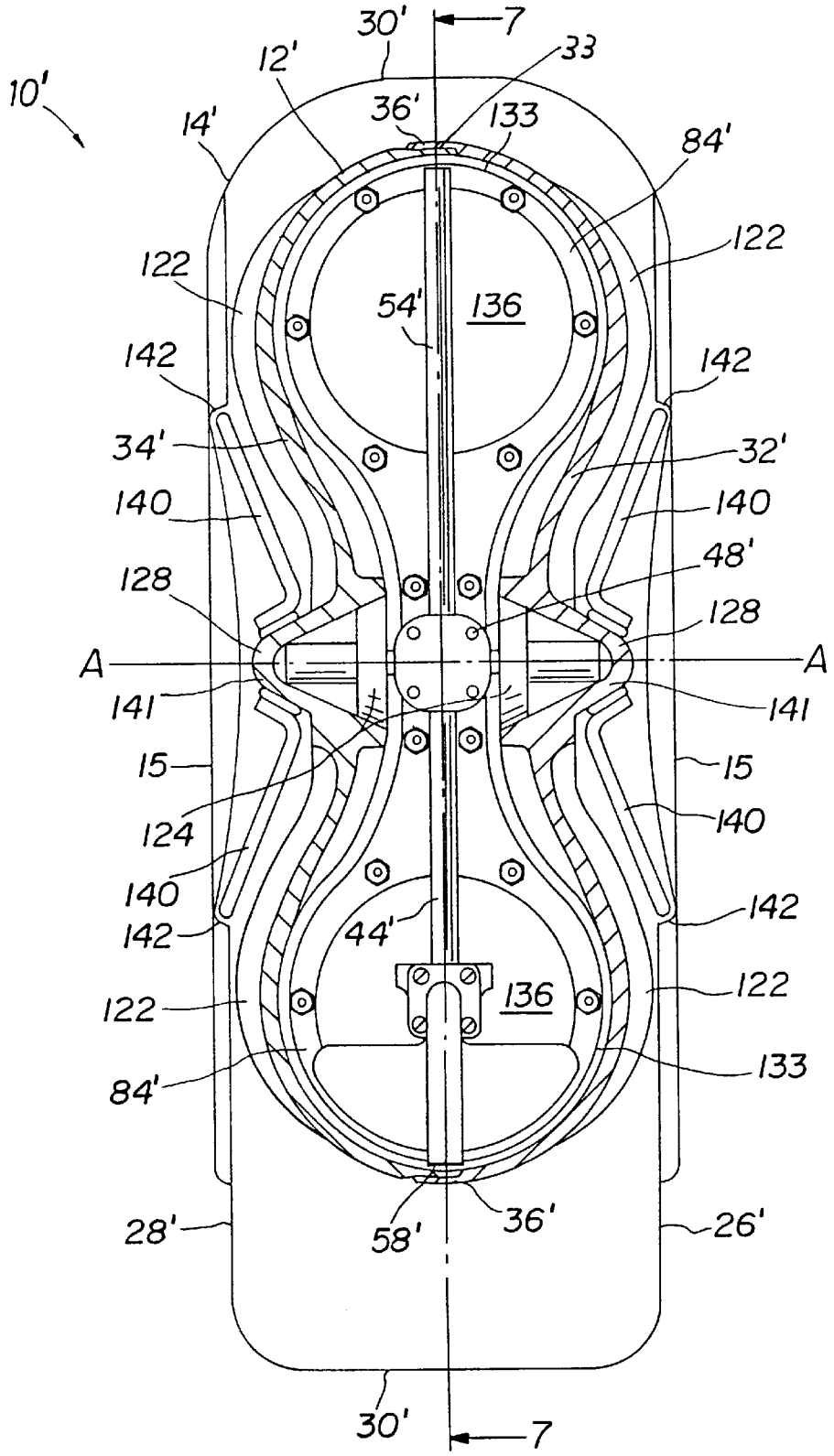
FIG. 6 is a sectional view of the pressure vessels of the dewar in a second embodiment alternative to that of FIGS. 1–5 along line 6—6 of FIG. 7.
Figure 7:
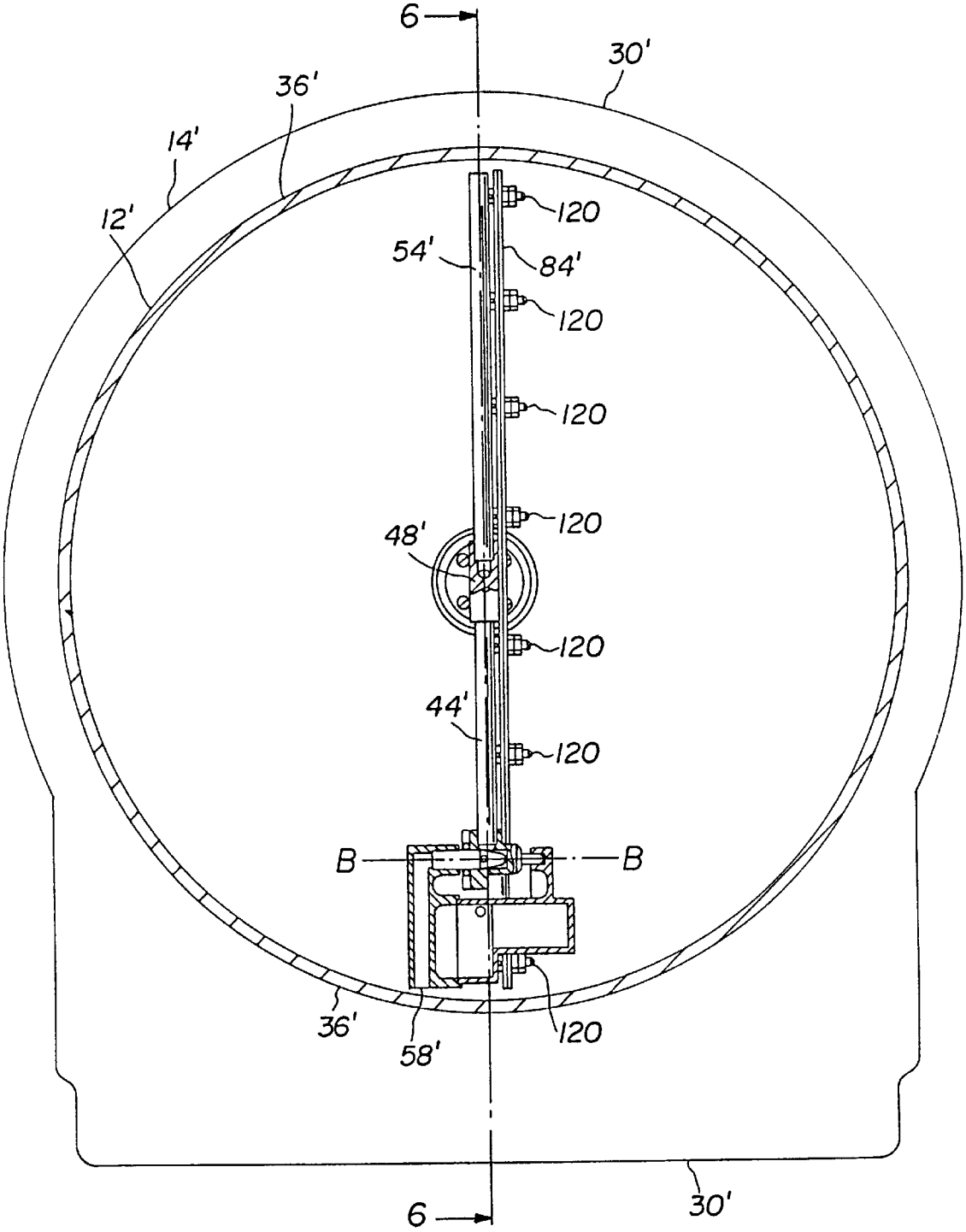
FIG. 7 is a cross-sectional view of the second embodiment shown in FIG. 6 along line 7—7.

Pressure vessel 12' comprises first end wall 32', second end wall 34', and side wall 36' formed by overlapping the inner edges of first and second end walls 32' and 34' at glue joint 33 as shown in FIG. 6. The inner surfaces of both wall 32' and wall 34' are substantially convex in longitudinal section, as shown in FIG. 6, and substantially circular in cross-section, as shown in FIG. 7. End walls 28' and 26' of insulative housing 14' can be similarly shaped so that the profile of insulative housing 14' conforms to that of pressure vessel 12' or may be shaped as shown in FIGS. 6–7.

Figure 9:
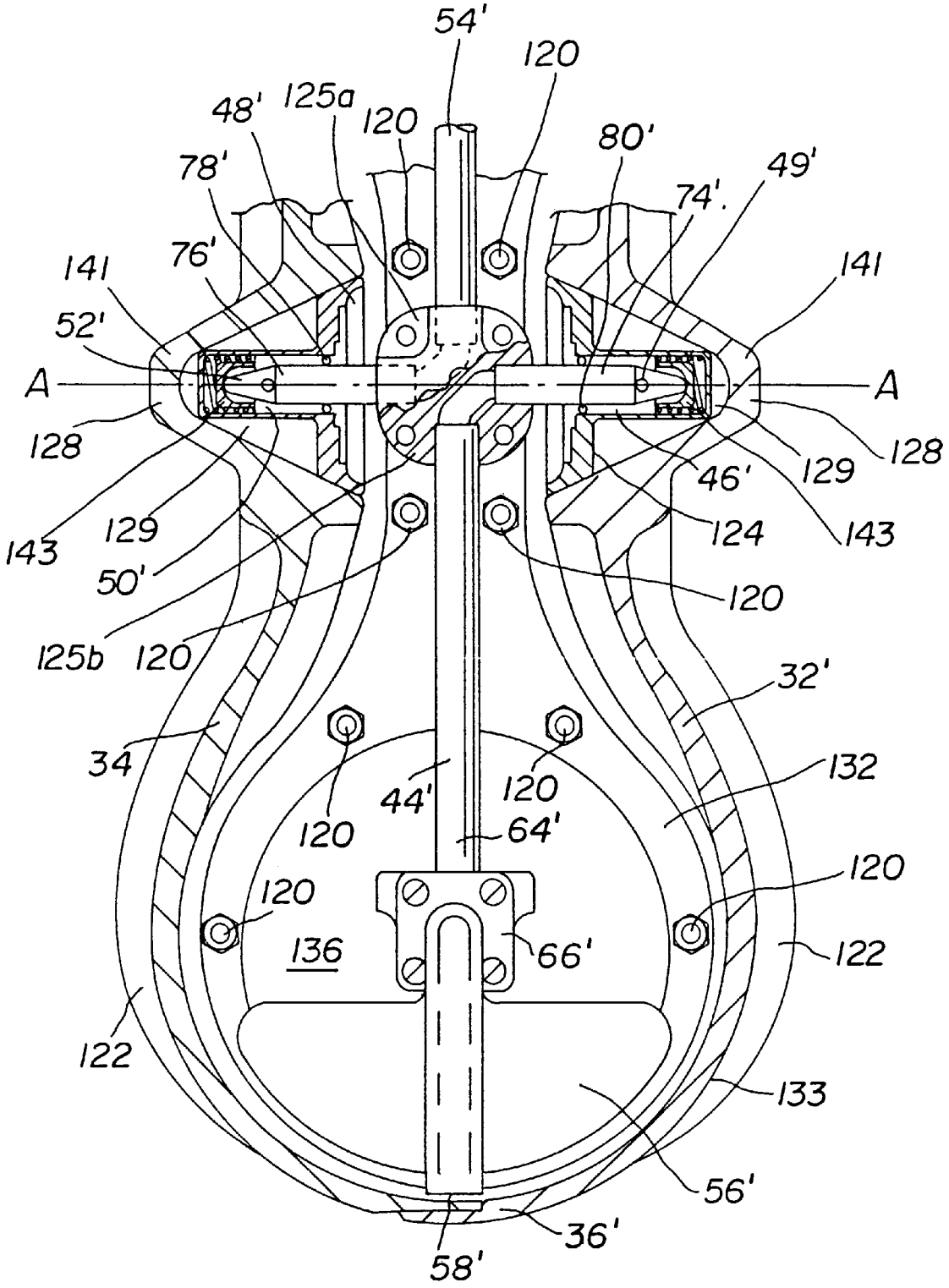
FIG. 9 illustrates the liquid cryogen pickup enlarged from the view of FIG. 6.

Pressure vessel 12' includes a plurality of ribs 122 extending outwardly from first and second end walls 32' and 34' and radially from midpoint 128 as shown best in FIG. 6 and also in FIG. 9. Pressure vessel 12', including ribs 122, may be constructed of any suitable material known to the art, preferably a thermoplastic. The materials for pressure vessel 12' may, however, be of any suitable type known to the art, the selection turning on well known design criteria such as weight, insulative properties, low dewar profile, and high volume.

The alternative dewar embodiment of FIGS. 6–9 mounts pressure vessel 12' within insulative housing 14' differently than does the embodiment of FIGS. 1–5. Thus, pressure vessel 12' is mounted on suspension cones 140 extending from raised pads 142 on interior wall 15 of housing 14' to bosses 141 on either side of pressure vessel 12'. Cones 140 support and thermally isolate pressure vessel 12' within insulative housing 14' and may be fabricated from any suitable, stiff, low thermal conductivity material known to those in the art.

The cone design complements the shape of pressure vessel 12' and insulative housing 14' by providing a stiff, low profile, thermally insulating path while supporting pressure vessel 12'. Cones 140 also balance the pressure and vacuum loads on pressure vessel 12' and the insulative housing and transfer some of the structural load of pressure vessel 12' to insulative housing 14'.

Pressure vessel 12' includes liquid cryogen intake or first conduit 44' and ullage member or second conduit 54' that rotate together about first axis A—A, as do conduits 44 and 54 in pressure vessel 12 of FIGS. 1–5. Although not shown in FIGS. 6–9 for the sake of clarity, conduits 44' and 54' are connected to means for supplying and delivering liquid cryogen and for supplying and venting gas such as is described above in FIGS. 1–5. The process for filling and venting liquid and gas from pressure vessel 12' are also the same as for pressure vessel 12 in FIGS. 1–5.

Figure 8:
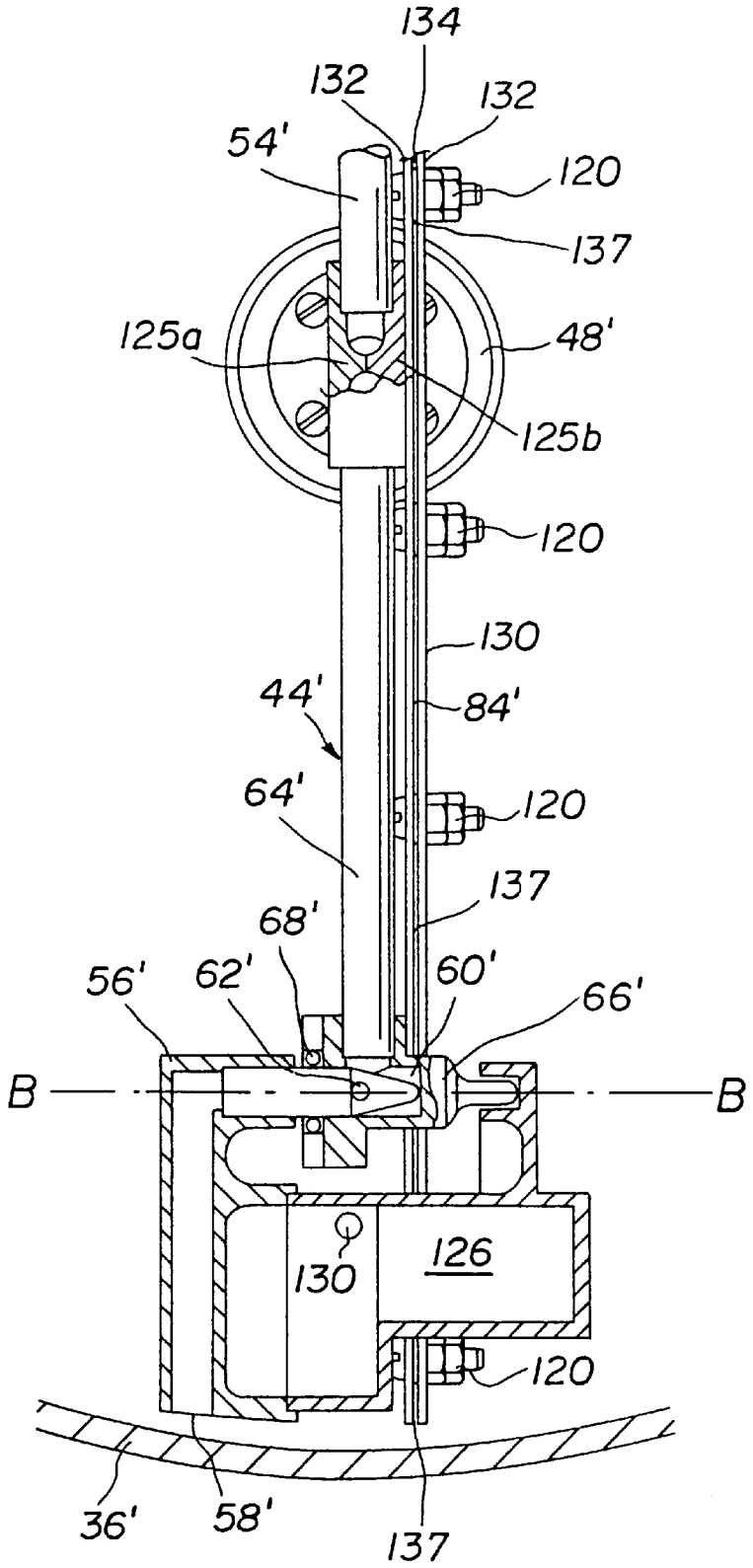
FIG. 8 is an enlarged cross sectional view of the liquid cryogen pickup of the second embodiment shown in FIG. 7.

Referring to FIGS. 8–9, central hub 48' comprises hub members 125*a–b* between which the inner ends of conduits 44' and 54', including tubular stems 74' and 76' thereof, are clamped to for rotating about first axis A—A shown in FIGS.

6 and 9. Hub members 125*a–b* may be fastened together by threaded screws, an adhesive, a bonding agent, or some combination of these techniques. Stems 74' and 76' are joined to the inner ends of conduits 44' and 54', respectively, as best shown in FIG. 9, and extend into chambers 46' and 50' of tubular bearing mounts 124 which have flanges on their inner ends seated in conical recesses 129 of bosses 141. Chambers 46' and 50' are sealed at the respective points of rotation of stems 74' and 76' by seals 78' and 80' to preserve the integrity of the fluid flow paths associated with conduits 44' and 54' as discussed elsewhere.

First conduit 44' has an inner end that connects with stem chamber 46' of central hub 48' through perforations 49' in stem 74'. Liquid cryogen thus enters enclosed channel 38 such as that shown in FIG. 5 from chamber 46' through the perforation and is then delivered via enclosed channel 38, as demanded.

Second conduit 54' is fluidly connected to an enclosed channel (such as that shown at 42 in FIG. 5) of the gas supply and delivery means such that gas may be supplied to or vented from the ullage of pressure vessel 12 as appropriate to regulate the ullage pressure in the vessel. Gas flows through conduit 54' to chamber 50' of central hub 48' through perforation 52' in the tube 76' to an enclosed channel such as that shown at 42 in FIG. 5, and out enclosed channel 42 to vent gas, i.e., the process of supplying gas via conduit 54' is simply reversed from that of venting.

First conduit 44' in FIGS. 6–7 is constructed analogously to conduit 44 of FIGS. 1–5 and comprises inner member 64' joined to outer member 56' as best shown in FIG. 8. Member 64' rotates about first axis A—A and outer member 56' rotates about axis B—B lying within a plane perpendicular to axis A—A. Like first conduit 44 of the embodiment in FIGS. 1–5, conduit 44' both circumscribes and sweeps side wall 36' through rotation about axes A—A and B—B to maintain the outer end 58' of outer member 56' immersed in liquid cryogen regardless of the vessel's orientation.

However, outer member 56' differs from that of conduit 44 in FIGS. 1–5 in the design in that, as shown in FIG. 8, it is a hollowed body having holes 130 through which cavity 126 may be filled with liquid cryogen stored in pressure vessel 12' to increase the mass of the end member, and thus its response to changes in orientation, thereby allowing the elimination of weight 69 shown in FIGS. 1–5. The shape of outer member 56' provides a "weather vane" effect in which outer member 56' moves as does the liquid, and its construction reduces the system mass available for transferring heat to the liquid cryogen in the vessel, as well as reduces the weight of the overall dewar.

Liquid cryogen enters outer member 56', and hence first conduit 44', via its open end 58' and thus into chamber 60' through perforation 62' to connect with member 64' of conduit 44'. The juncture between member 56' and main piece 64' is best shown in FIG. 8. Hub 66' is fixedly attached to the end of member 64' in which perforation 62' is formed, with end member 56' thus rotating about axis B—B with respect to the end of member 64'. Chambers 46', 50', and 60' are sealed by seals 78', 80', and 68', respectively.

First conduit or intake member 44' and second conduit or ullage member 54' are sufficiently long to extend nearly all the way to end wall 36' and therefore circumscribe end wall 36' of pressure vessel 12' as they rotate about axis A—A. However, second conduit 54' is somewhat shorter than first conduit 44' for reasons described below in regard to the filling process. The open end 58' of outer member 56' of the first conduit further sweeps the interior of vessel 12' as it rotates about axis B—B as the upper member 64' rotates about axis A—A, in similar fashion to pressure vessel 12 shown in FIGS. 1–5. Pressure vessel 12' is bilaterally symmetrical, i.e., consists of bilateral "mirror images", along the plane represented by section line 7—7 in FIG. 6 (except perhaps prior to the gluing of the arcuate ends which meet at joint 33 to form side wall 36' as seen in FIG. 6). The design of pressure vessel 12', in conjunction with first conduit 44' and second conduit 54', permits better accessibility to the lowest point within pressure vessel 12' in all orientations through the range of motion of intake opening 58' of outer member 56' and, thus access to a larger percentage of the liquid cryogen in the dewar than in the embodiment of FIGS. 1 to 5.

Capacitance gauge 84' differs in construction from its counterpart gauge 84 in FIGS. 1–2 and 4–5, although it also measures capacitance as a function of liquid level. As best shown in FIGS. 8–9, gauge 84' comprises two metallic plates 132 with openings 136 in major portions thereof and having gap 134 therebetween. When pressure vessel 12' is filled with liquid cryogenic fluid, the fluid fills gap 134 of gauge 84' to act as the dielectric between conducting plates 132. Outer edges 133 of plates 132 are shaped concentrically with the interior profile of the walls of pressure vessel 12' as best shown in FIGS. 6 and 9.

Plates 132 are joined by fasteners 120, which are preferably plastic nuts, bolts, or washers, although other suitable materials may be employed. Washers 137 which are made of plastic or some other electrically insulative material, are mounted on bolts 120 between plates 132 maintain the gap between members 132 and prevent an electrical short across gap 134. Holes 136 control the total submerged surface area of plates 132 and therefor permits control over the reading taken with gauge 84'. Holes 136 in plates 132 are not strictly necessary for the function of gauge 84' and, although preferable, may be omitted in some embodiments. However, holes 136 are sized to maintain gauge linearity for any given interior profile of pressure vessel 12' and consequently necessary to maintain such linearity for most interior profiles.

One of plates 132 is electrically connected to tubular stem 74' while the other of plates 132 is electrically connected to tubular stem 76'. Both of stems 74' and 76' contact spring-mounted cups 143 electrically connected to tubular mounts 124. Each of stem 74', stem 76', cups 143, and mounts 124 are constructed from metallic or other electrically conductive materials and form part of an electrical circuit. An insulated electrical wire (not shown) is then affixed to each of mounts 124 through the enclosed channels and outside dewar 10' as in the embodiment of FIGS. 1–5 to complete the electrical circuit.

Gauge 84' is affixed to stems 74' and 76' and clamped by hub members 125*a–b* of central hub 48' as are second conduit or ullage member 54' and first conduit or intake member 44' as described above. Gauge 84' consequently rotates with conduits 44' and 54' about axis A—A. In some embodiments, gauge 84' may be electrically connected to stems 74' and 76' by the same means with which it is affixed to central hub 48' for rotation, as with a metal clamp.

The shape of plates 132 is such that rotation about axis B—B is not needed to ensure measurement along side wall 36'. This is true regardless of the gravity vector because the outer ends of plates 132 conform to the interior profile of pressure vessel 12', which, in conjunction with the bilateral symmetry of pressure vessel 12', allows the wetted surface area of gauge 84' to remain the same in all orientations for a given amount of liquid cryogen. The capacitance measured by gauge 84' is therefore directly proportional to the amount of fluid in pressure vessel 12' regardless of how pressure vessel 12' is oriented relative to the gravity vector. The proportional relationship provided by gauge 84' is an improvement over that provided through gauge 84, wherein in some orientations the relationship is not constant.

Figure 10:
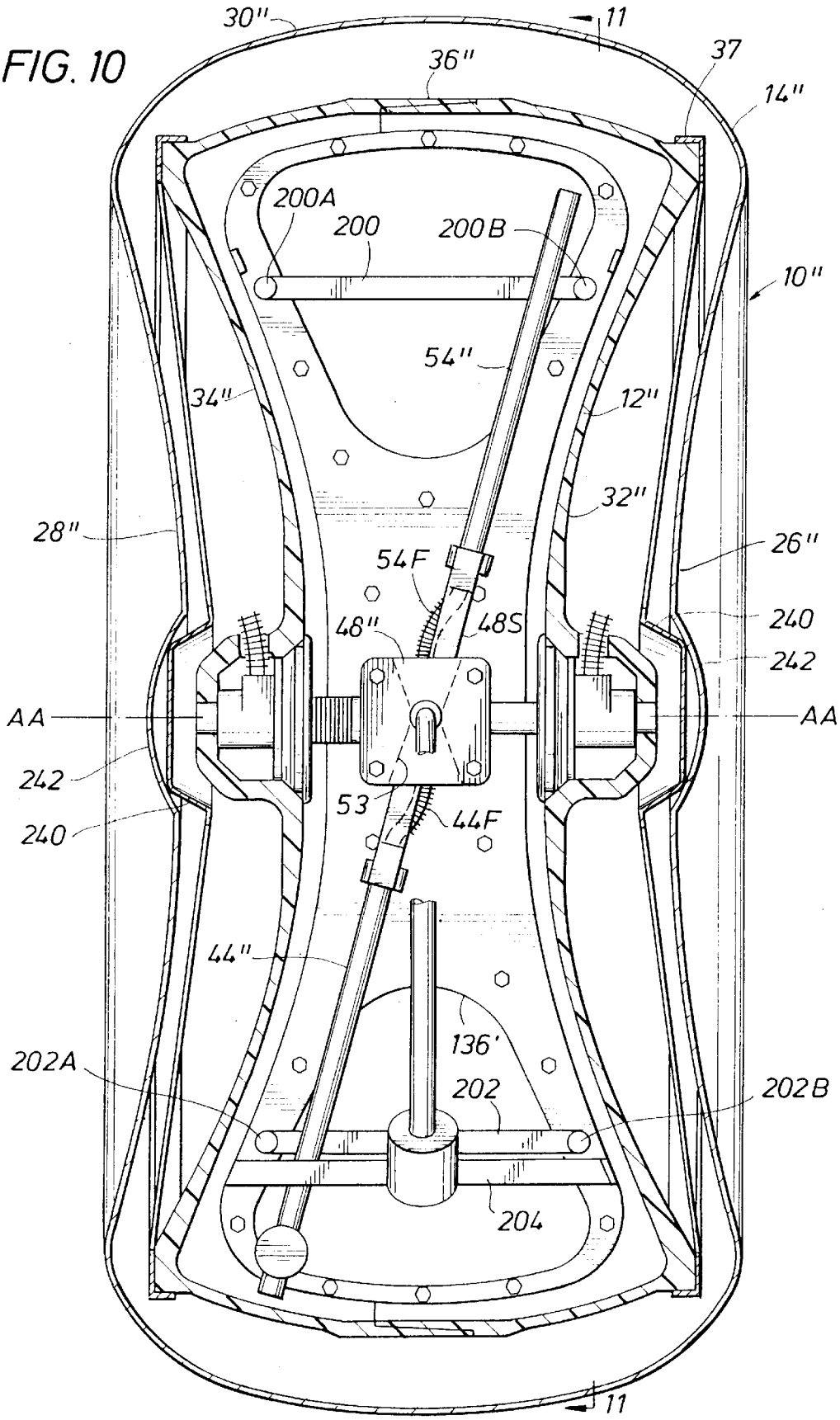
FIG. 10 is a longitudinal sectional view of a dewar constructed in accordance with the third and preferred embodiment of this invention, and as seen along line 10—10 of FIG. 11.

The third and preferred embodiment of the dewar, which is shown in FIGS. 10 to 18 and indicated in its entirety by reference character 10", comprises, as in the case of the first and second embodiments, a pressure vessel 12" supported within an outer housing 14" and insulated, as by means of evacuation of the space between it and the outer housing when the pressure vessel is part of a dewar, as in the case of the dewar 10". As was also true in the case of the prior dewars, the outer housing includes end walls 26" and 28", which are of circular configuration, as seen from the side, and whose outer peripheral edges are joined by a circumferential side wall 30" extending between them. The pressure vessel, on the other hand, is of a cross-section at least approximating that of the inner surface of the housing, and comprises, as in the case of the prior dewars, end wall 32" and 34" having their outer edges joined by a circumferential side wall 36". As was also true in the prior dewars, the pressure vessel is mounted about an axis AA extending transversely of the vessel and housing, as shown in FIG. 10, concentrically of the side wall.

More particularly, the end walls of the pressure vessel are each curved convexly with respect to one another, as in the dewar of the second embodiment of FIGS. 6 to 9. More particularly, the side wall is inwardly concave and shaped arcuately about an axis BB which is disposed within a plane perpendicular to the axis AA, as in the second embodiment.

More particularly, and as previously described, the end walls as well as the side walls of the pressure vessel are spherically shaped. Thus, the end walls are spherical about centers lying within the axis AA on opposite sides of the vessel, as seen in FIG. 10, while, as compared with the second embodiment, the side wall is spherically shaped about a center at the intersection of axes AA and BB. The resulting pressure vessel 10" is the intersection of three imaginary spheres, two of which define the end walls while the third sphere defines the side wall. Since a sphere is a perfectly balanced pressure vessel, the utilization of spherically shaped end and end walls in vessel 10" optimizes its structural integrity. Thus, the side wall is in near equilibrium with the end walls, while the end walls are in near equilibrium with one another and with the side wall. As also previously described, this configuration of the vessel not only maximizes its strength, but also, as will be understood to follow, minimizes the possibility of gas entering first conduit 44".

To further add to the strength of the vessel, its outer corners, at the intersection of its end walls and side wall, are enlarged and provide intersecting flat horizontal and vertical surfaces to form a square corner. Reinforcing ring 37 is fitted closely about this enlarged corner through a shrink fitting process to contain the hoop stresses developed in the vessel, such as from internal gas pressure, whereby the end and end walls are brought into more complete equilibrium with one another from a load bearing standpoint. This combination of spherically shaped vessel 12" and ring 37 enables the use of relatively thin walls for the vessel whereby a weight reduction in dewar 10" is realized. In contrast to other dewar designs, vessel 12" needs no structural reinforcing ribs, which further contributes to a weight reduction. As indicated previously, such reductions are extremely important because they provide corresponding increases in the available cryogen capacity of the dewar, while maintaining design weight constraints for the fully loaded dewar.

Thus, at ambient, unloaded conditions the inner diameter of ring 37 is substantially equal to or slightly less than the outer diameter of the vessel's outer corners. Shrinkage of vessel 12" is induced by exposing the vessel to a cold source, and expansion of ring 37 is induced by exposing the ring to a heat source. The relative dimensions of the vessel corners and the ring are such that the expanded ring will just fit about the shrunken corners of the vessel. As a result, the vessel corners are preloaded in compression while the ring is preloaded in tension when the temperatures reach equilibrium and the two will not separate when the vessel is filled with cryogen.

Figure 18:
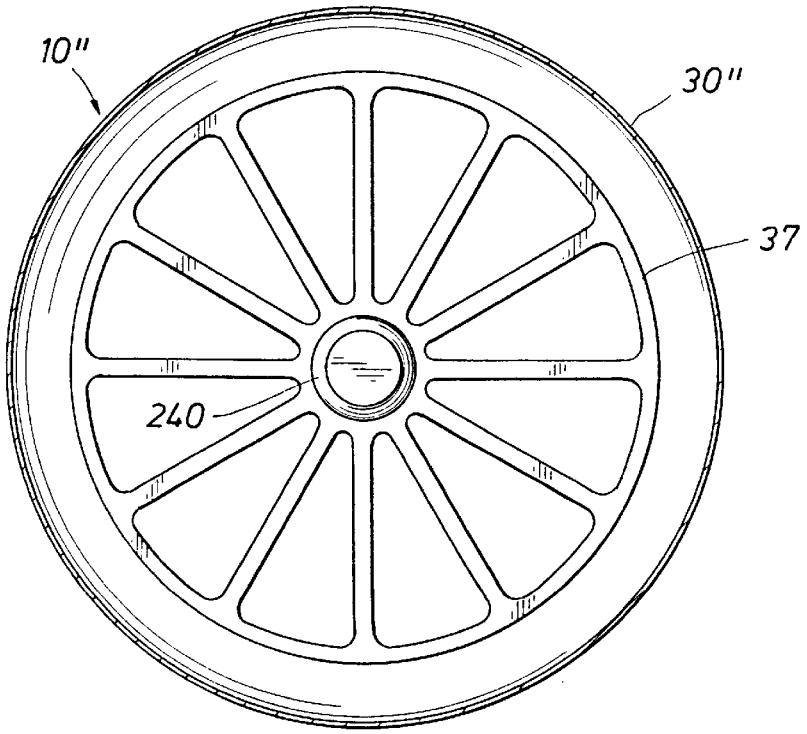
FIG. 18 is a side view of the spoke-like devices mounted on each side of the vessel to support it within the outer housing.

As shown in FIGS. 10 and 18, this ring is mounted on the radially extending spokes of a ring shaped member 240 which in turn is held within cup shaped parts 242 on the end walls 26" and 28" concentrically of the axis AA. Upon mounting of ring 37 about the vessel's corners, the center of the ring member is caused to tightly engage the cup shaped parts of the end walls of the outer housing. Those skilled in the art will appreciate that, contrary to the first and second embodiments discussed above, outer housing 14" provides no structural support for vessel 12", but provides a barrier that protects the integrity of vessel 12" and reduces the rate of heat transfer between the cryogen in vessel 12" and the atmosphere outside housing 14".

As was also the case in the prior dewar embodiments, the dewar 10" includes first and second conduits 44" and 54" each mounted on a central hub 48" which is rotatable about the axis AA within the pressure vessel, with the conduits extending in opposite directions generally radially from the axis AA. As will be described in more detail to follow, each of the conduits is also mounted on the hub for rotation about axis BB, whereby in addition to circumscribing the inner surfaces of the side wall, the outer open ends of the first and second conduits sweep the side wall as they rotate about the axis BB between positions near one end wall or the other. Thus, as can be seen, the hub is located generally concentrically about the intersection of the axes AA and BB for rotating about the axis AA. As in the case of the prior dewar, first conduit 44" is a liquid intake that delivers liquid cryogen to hub 48" according to the demand for breathable air and/or for a cooling medium as determined by the user of the dewar, and second conduit 54" is a component of the gas supplying and venting means and extends into the ullage space in vessel 10" for regulation of the pressure imposed on the liquid cryogen.

Thus, as shown in FIG. 10, for example, the open end of the first conduit is close to the left hand lower corner of the pressure vessel, while the open end of the second conduit is near the upper right hand corner thereof. On the other hand, upon changing of the orientation of the dewar from the position of FIG. 10, the first and second conduits may swing into the positions shown sequentially in FIGS. 13, 14 and 15 and then back to the position of FIG. 10, as illustrated by the broken lines in FIG. 16. As will be described in detail to follow, rotation to the FIG. 16 position may be induced by means of the aforementioned kicker which is shown to have rotated from the position of FIGS. 10 and 11 to that shown partly in broken lines in FIGS. 16 through the sequence of FIGS. 13 to 15.

As in the case of the prior embodiments, first conduit 44" is of a length to dispose its open outer end close to the inner periphery of the side wall of pressure vessel 12" so that it circumscribes the side wall during rotation with central hub 48" about axis AA. At the same time, the open end of second conduit 54", which extends a shorter distance outwardly from the hub, and thus for a length only sufficient to maintain it above the liquid level of the vessel in the position of, for example, FIG. 10, is adapted to rotate with the first conduit between positions shown in the various figures. By virtue of their rotation about the axis BB, the open ends of the first and second conduits are caused to sweep the spherical inner surfaces of the side wall, thus adding to the abilities of the open end of the first conduit to remain within the liquid level and the open end of the second conduit to remain above the liquid level, in practically all orientational positions of the dewar.

Second conduit 54" is shorter than first conduit 44" because the second conduit is used to indicate when vessel 12" is "filled", such as when using fill lines 39–40 described above. When the height of the liquid cryogen just exceeds the open end of the second conduit, the liquid will flow under gravity into conduit 54" and the gas supply and venting means at which time the filled condition will be noted. Because the open end of conduit 54" is not immediately adjacent the inner surface of side wall 36" there is sufficient ullage space for pressurizing the liquid cryogen in the vessel, either by vaporization of the liquid and/or by precharging the ullage space with gas from an external source.

Figure 11:
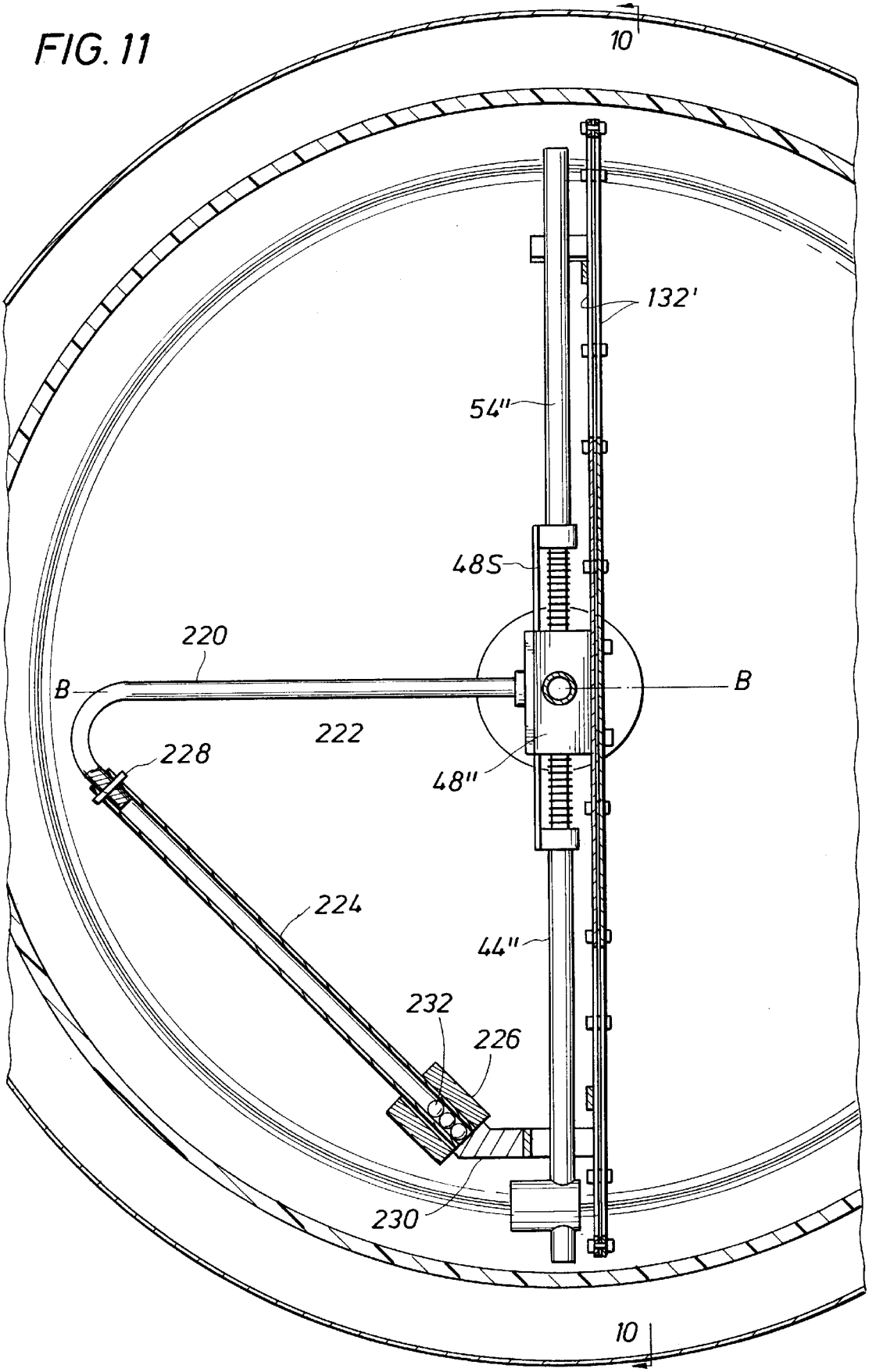
FIG. 11 is another longitudinal sectional view of the dewar of FIG. 10, but as seen along lines 11—11 of FIG. 10.
Figure 17:
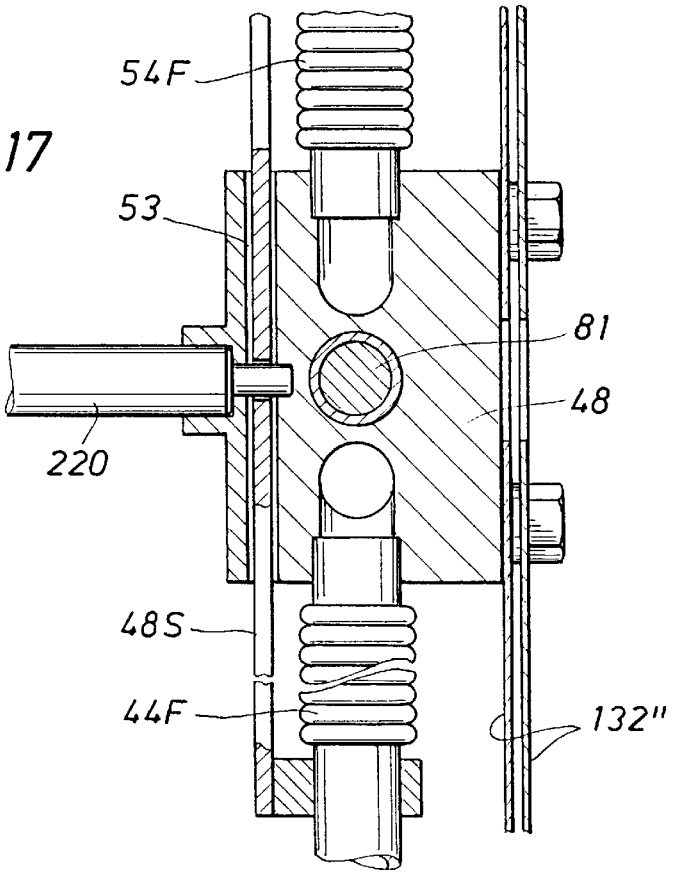
FIG. 17 is a cross-sectional view of the central hub, as seen along lines 17—17 of FIG. 12, and showing the connection of the inner ends of the first and second conduits to passageways in the hub.

The dewar 10" also includes a capacitance gauge which in many respects is similar to the capacitance gauge described in connection with the second embodiment 10' of the dewar. Thus, it includes a pair of plates 132' which, as best shown in FIGS. 11 and 17, are mounted on the central hub in closely spaced relation to provide a gap therebetween, whereby the measured electrical potential between the plates indicates the depth of the liquid in the vessel. As was also true of the plates of the second embodiment of the dewar, the outer edges of the plates 132' conform generally in shape to the inner surface of the pressure vessel and have relatively large openings 136' in their opposite ends to reduce drag as they rotate with the first and second conduits, thus facilitating movement of the open ends of the conduits toward the desired positions. Furthermore, the holes in the plates ensure that the level of liquid cryogen in vessel 12" corresponds in an approximate linear fashion to the "wetted" area of plates 132'. As shown, the plates are bolted to one another, with the inner bolts securing them to the backside (FIG. 10) of hub 48".

Those skilled in the art will appreciate that the preferred embodiment of dewar 10" depicted in FIGS. 10–18 exhibits advantages over both the first and second embodiment shown in FIGS. 1–5 and 6–9, respectively. For example, the first embodiment includes inner and outer liquid intake members connected through a sealed rotary joint that increases the overall system complexity and weight.

In the second embodiment, as seen in FIG. 6, the weight and complexity of the first embodiment are reduced. For example, dewar 10' has eliminated weight 69 and has replaced capacitance gauge 84 and bracket 87 (see FIG. 1) with plates 132 (see FIG. 8), both changes resulting in fewer components and less overall weight for dewar 10'.

The third and preferred embodiment of the dewar, referenced as 10", further improves over the first and second embodiments in its use of vessel 12" that is structurally independent from outer housing 14". Also, first conduit 44" is essentially a single-pieced member extending substantially from hub 48" to side wall 36", thereby reducing its complexity and weight. Dewar 10" is further provided with a "kicker," described further below, for overcoming frictional resistance to the rotation of the first and second conduits about axis AA.

Figure 12:
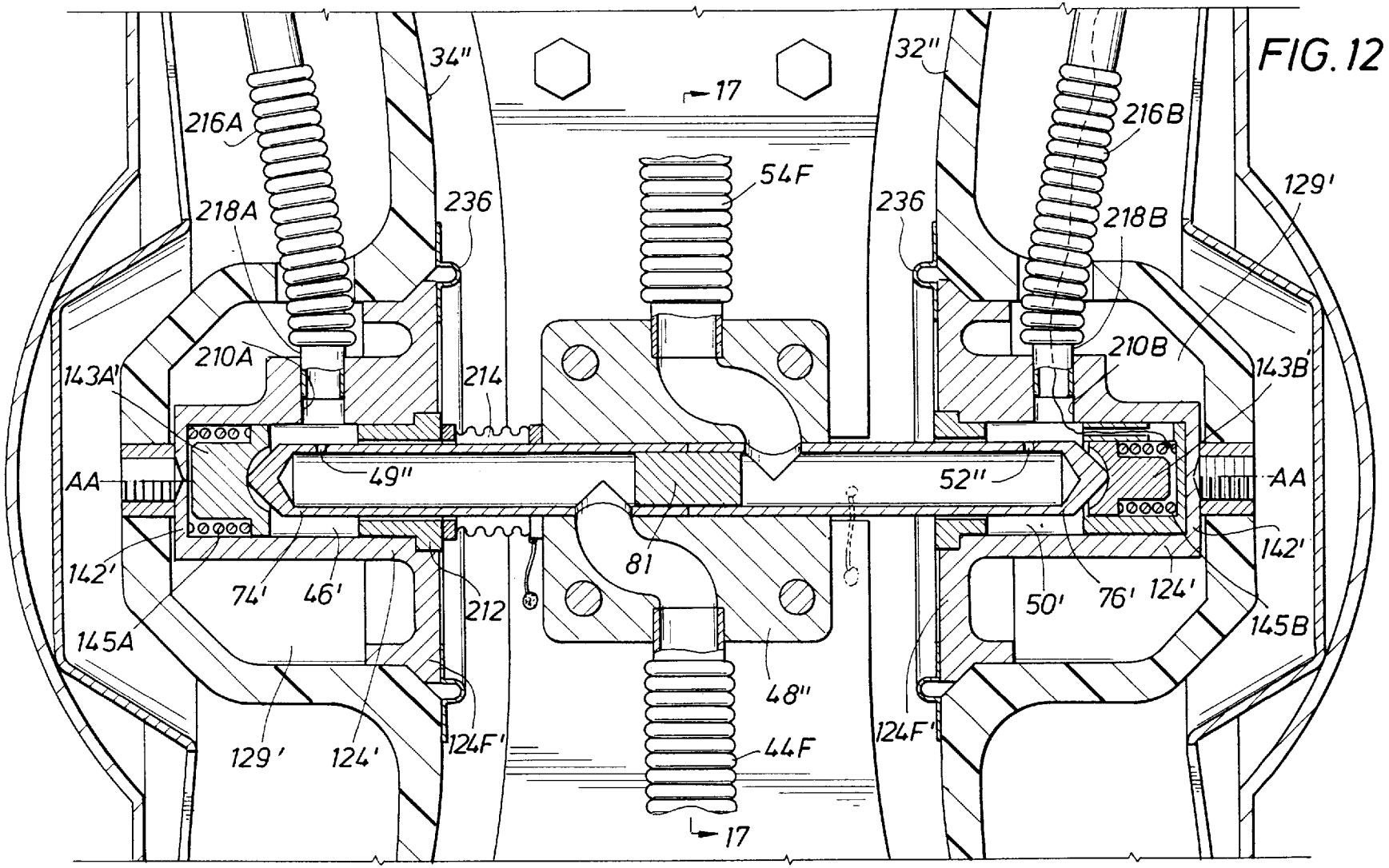
FIG. 12 is an enlarged cross-sectional view of the hub and its axles received within bearings on each end wall of the dewar.
Figure 13:
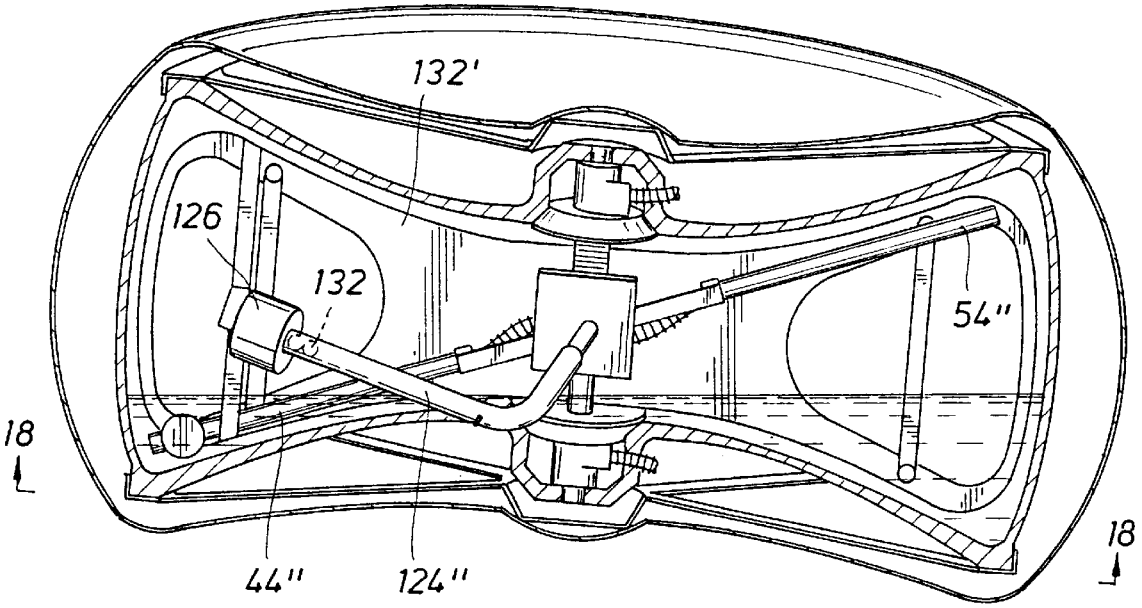
FIGS. 13 to 16 are perspective views from the top and one side of the dewar, taken in section to show the progressive movement of the first and second conduits as they rotate with the hub in response to progressive tilting of the dewar and upon rotation of the kicker from the positions of FIGS. 13 to 15 to that of FIG. 16 to induce such rotation.
Figure 14:
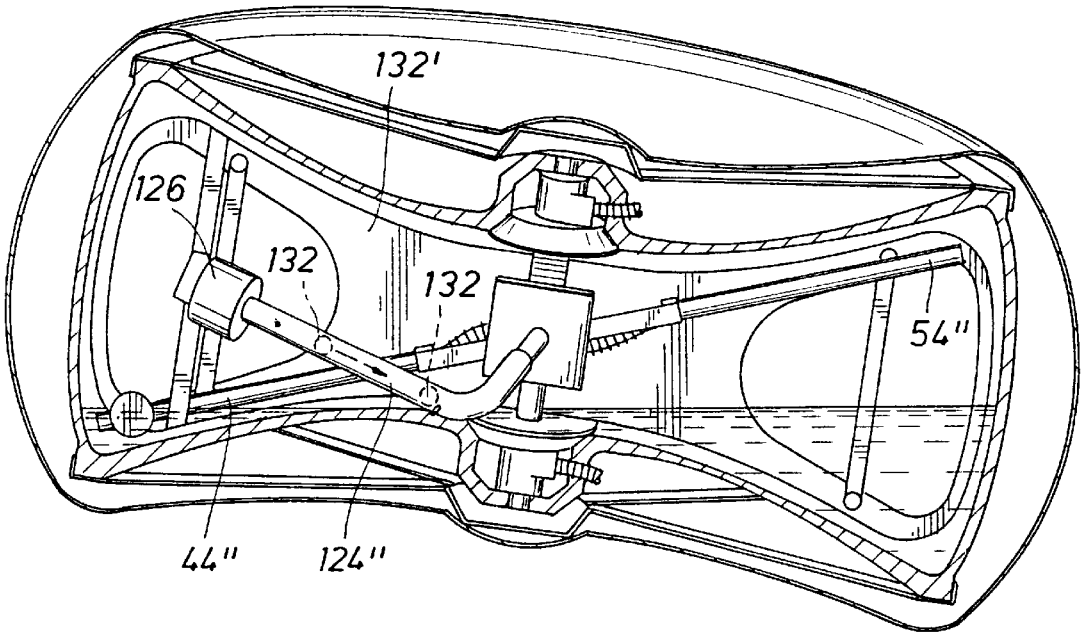
Figure 15:
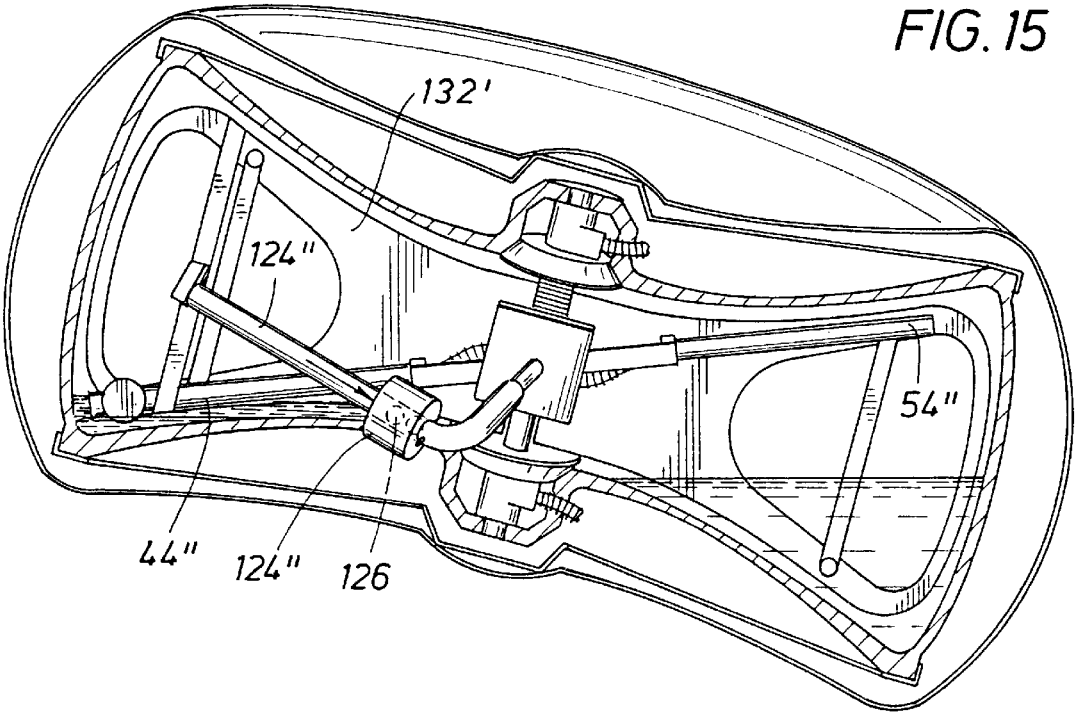
Figure 16:
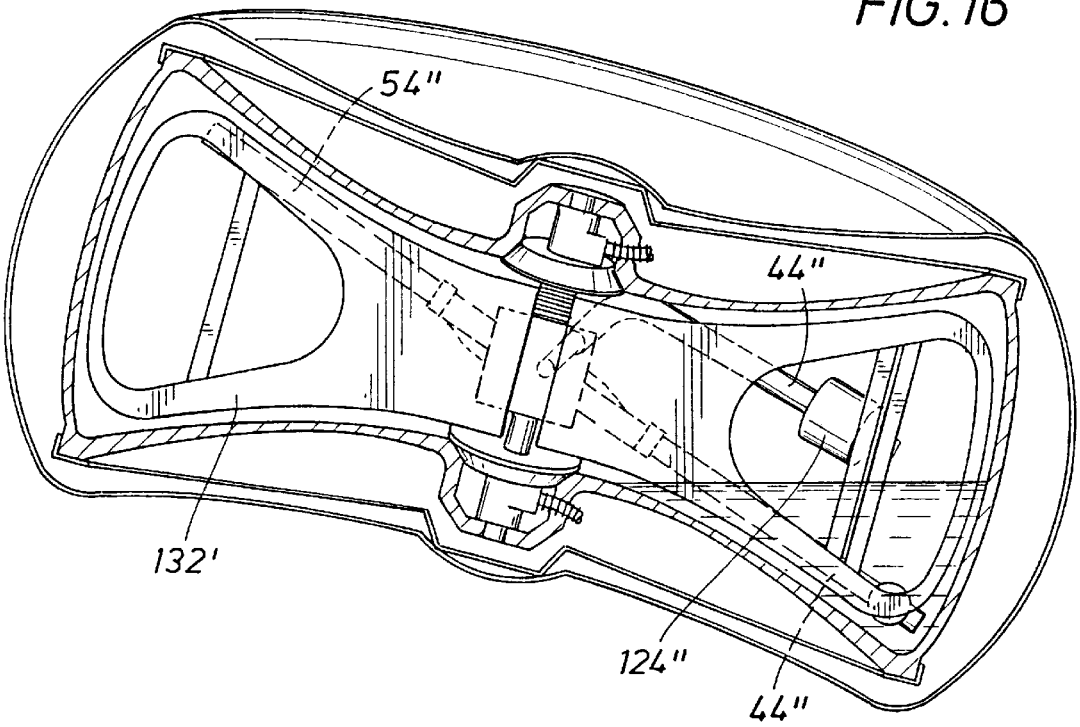

Referring now to FIG. 12, central hub 48" has a pair of chambers therein, each curved to connect with the inner ends of one of the first and second conduits 44" and 54". More particularly, these chambers connect with central passageways in tubular stems 74' and 76' on opposite sides of hub 48" to provide axles rotatably mounted about axis AA within bearings on the inner sides of each of the end walls 32" and 34". As shown, and as will be understood from the description to follow, the inner ends of the central passages connect with the inner ends of the first and second conduits through the curved chambers at laterally offset locations. The central passageways are separated from one another by a wall 81 between the stems so as to form separate fluid paths between the first and second conduits and their extensions outwardly of the pressure vessel and dewar as a whole.

Each of the first and second conduits includes a rigid tube having its inner end connected by means of flexible tubing 44F,54F, respectfully, to one of the passageways in the hub leading to the central passageway, as shown in FIG. 10. More particularly, the rigid tubes are connected for rotation together about axis BB with respect to the central hub by means of a strut 48S best shown in FIGS. 10 and 11, as well as in FIG. 17. Thus, the strut is mounted on the side of the hub opposite that of the capacitance gauge (see FIG. 17) and has collars at its opposite ends which surround the inner ends of the rigid tubes of the conduits. More particularly, the strut extends through a slot 53 in the hub adjacent its left side as shown in FIG. 17. As also indicated in broken lines in FIG. 10, the slot is made of opposed V shapes permitting angular movement of the strut in response to rotation of the conduits about the axis BB.

The rigid tubes of the first and second conduits are guided for swinging movement about the axis BB by means of bosses 200A/B,202A/B and bars 200,202 extending between opposite sides of the capacitance gauge plates, and, more particularly, by spaced bars 202,204 extending across the sides of one end of the plates as shown in FIG. 10. These bars are relatively thin as seen from the side so as to provide minimum interference to the swinging of the capacitance plates with the conduits.

Referring again to FIG. 12, tubular bearing members 124' are mounted to rotatably support the outer ends of the stems or axles through which hub 48" rotates. The bearing members are formed of a body, which may be a casting, and which is received within a cavity 129' protruding from and within each end wall of the inner vessel. More particularly, each such bearing body has an outwardly extending open end 142' which is secured by bolts 143 to the side wall of the cavity so as to maintain the bearings' axial alignment with one another along the axis AA. The engagement of bolts 143 with open ends 142' further permit vessel 12" to be leak checked by applying a vacuum to the interior of the vessel, without risk of causing bearing members 124' to be pulled from their respective cavities 129' by the applied vacuum. Each bearing member also has an annular flange 124F' extending radially from its inner end to engage at its outer rim with a respective end wall of the vessel adjacent the opening into the cavities. More particularly, the flanges are held tightly against the inner wall of the pressure vessel by the threaded engagement of bolts 143 and open ends 142' of the bearing members to separate cavities 129' and the interior of vessel 12", and to transfer the forces developed at hub 48" into end walls 32" and 34".

With reference again to FIG. 12, a cup member 143A' is received in outer end 142' of the tubular extension of bearing 124' and is urged by coil spring 145A into engagement with the pointed end of the left hand stem or axle 74' connecting at its inner end with the left hand central passage in the hub and thus with the inner end of the first conduit. As shown, the axle is ported at 49" near its outer end to connect the passage therein with the pressure chamber 46' about the axle and thus with a hole 210A in bearing 124' leading to the inner end of a flexible portion 216A of a tube which extends through the space between the pressure vessel and the outer housing, thus providing part of the means by which the vessel may be filled with or deliver liquid cryogen. More particularly, the flexible portion 216A extends freely through a hole in end wall 34" of the vessel, with its inner tubular end 218A being sealably received within side opening 210A in the tubular extension of the bearing and thereby defining the flow of liquid between the tubing leading to the outside of the dewar and the interior of the vessel through the first conduit and the left hand axle.

A bearing sleeve 212 of aluminum is received in a counter bored portion of the inner end of the opening in bearing 124' for loosely receiving stem or axle 74', and a bellows 214 surrounds the left hand axle and is secured at its right end to hub 48". The left end 214S of the bellows has a TEFLON face for forming a rotating seal with a TEFLON face on the inner end of the bearing sleeve 212, thus sealing interior chamber 46' about a portion of the axle which extends from the hub. As shown in FIG. 12, a diaphragm 236 extends across the intersection of the outer diameter of bearing flange 124P' and end wall 34" so as to seal cavity 129' from the inside of the pressure vessel. Cavity 129' is exposed to the vacuum pressure between vessel 12" and housing 14" via the opening through which flexible tube portion 216A passes. The inner edge of the flange is tightly engaged with a conically shaped surface at the intersection of the end wall with the bearing flange.

Also shown in FIG. 12, the interface between bearing sleeve 213 and stem or axle 76' extending from the right side of the hub to connect with the inner end of second conduit 54", is of more precise construction than that of the left axle so as to provide a rotary shaft seal separating chamber 50' from the inside of the pressure vessel. The position of hub 48" is thus precisely maintained relative to axis A—A via stem 76', while stem 74' exhibits a tight, virtually frictionless rotating seal assembly for controlling leakage of liquid cryogen from vessel 12". Diaphragm 236 is disposed over the adjacent surfaces of the right hand end wall and the right hand bearing housing flanged portion 124P' to provide sealing capability to maintain the annular cavity 129' about the tubular extension of the right hand bearing and the interior of the pressure vessel separate from one another.

The outer end of the right hand axle or stem connects with flexible portion 216B of the inner end of a tubular member extending outwardly of the vessel through an opening in end wall 32" in the pressure vessel. More particularly, the connection is made through open end 218B sealably mounted in opening 210B and port 52" in stem 76', whereby the pressure of the ullage above the liquid level can be regulated.

As shown in FIG. 12, a wire or coaxial cable 217 extends through this tubular member including its flexible portion 216B from the outer end of the tubular member to coil spring 145B and/or cup member 143B' for electrical connection with one of plates 132' through stem 76'. Wire 217 electrically connects the other of plates 132' to bellows 214. Thus, the circuit is completed since one of the plates is connected to the live or "hot" cable 217, while the other of the plates is connected to a ground via bellows 214 and the tubular member including flexible portion 216A. In this fashion, cable 217 extending from outside dewar 10" to one of plates 132' of the capacitance gauge transmits an electrical signal indicative of the potential across the gap in the plates, whereby the amount of liquid cryogen in vessel 12" can be determined.

As previously mentioned, the preferred dewar 10" also includes a kicker which is supported on central hub 48" to one side thereof for rotation with the hub about the axis AA, as seen in FIG. 11. Thus, as shown, the kicker comprises a pair of arms 222 and 224 which are mounted for rotation with the hub, and thus with the first and second conduits, generally within the plane which extends perpendicularly to the axis AA and contains axis BB.

A first arm 222 has its inner end mounted on the side of the hub opposite the capacitance gauge, as shown in FIG. 17, and extends generally radially away from the hub along axis BB. A second arm 224 extends diagonally from its outer end near the side wall of the vessel, and the outer end of the second arm intersects with the outer end of the first arm to form an elbow. Thus, the first and second arms 222 and 224 are arranged as a right triangle with arm 224 forming the hypotenuse which extends from a first end (at the elbow) adjacent the intersection of the second axis BB and the inner surface of the side wall and a second end positioned generally along a third axis orthogonal to the first and second axes. Thus, as best shown in FIG. 11, the kicker will, in any of its positions, occupy generally one quadrant of the cross-sectional area of the pressure vessel as viewed from the side.

More particularly, at least the second arm 224 forming the hypotenuse is straight so that a weight 226 slidably disposed thereabout is free to slide between stop ring 228 near its intersection with the first arm and a bar 230 mounted on the capacitance gauge and having an oppositely facing stop surface to that of ring 228.

It is not essential, however, that bar 230 be mounted to the capacitance gauge. For example, in an alternative embodiment (not shown) bar 230 is substituted with another end ring defining a second stop independent from the capacitance gauge and complementing the first stop defined by ring 228. The two stops define boundaries between which the weight can slide.

Thus, as will be understood, the weight is free to slide in opposite directions along the arm in response to orientation of the dewar relative to the direction of an external force such as gravity. In this manner, the kicker varies or offsets the center of mass of the pivotal assembly that includes hub 48", and first and second conduits 44", 54" to prevent the assembly from achieving a semi-stable "sticking" position that would inhibit conduit 44" from freely following the liquid cryogen about vessel 12". The momentum at impact of the weight with one of the outer stop surfaces provides a jarring force which induces rotation of the central hub and conduits for the purpose of overcoming the frictional resistance to rotation due to the rotary joint between the stem 74' and the bearing in which its outer end is rotatably mounted, although the TEFLON surfaces of the face seal between the bellows 214 and the bearing sleeve 212 on the bearing housing further reduce frictional service to a minimum.

This jarring force is further enhanced by means of a series of weighted parts 232 slidable within hollowed second arm 224 in response to orientation of the dewar in the same sense which causes the weight slidable about the second arm to move from one end to the other thereof. As shown, these weighted parts are balls, although they obviously could be of other shape depending on the interior configuration of the arm. When balls 232 are utilized, it is they that initiate movement along arm 224 and weight 226 moves similarly thereafter.

A process for rapidly filling the pressure vessel of the dewar with liquid cryogen will now be described, as conceptually illustrated in FIG. 19, in the context of the first embodiment of the dewar shown in FIGS. 1–5. However, the process is equally applicable to the second and third (preferred) embodiments of the dewar. Container 102 is a source of air (or some other gaseous cryogen) under pressure, typically 3,000–4,000 psi, at ambient temperature or higher. The compressed air may be obtained by compressing ambient atmosphere or purchased by the bottle already compressed. Either way, the compressed air must be scrubbed and filtered to remove carbon dioxide, water, argon, and other contaminants to produce a gaseous mixture primarily composed of nitrogen and oxygen. The pressure and temperature of the cryogen in container 102 is not particularly important as long as the pressure is supercritical.

The cryogen is released from container 102 through valve 104, which may be automated or manual and may be any one of many known to the art, and then regulated by pressure reducer/regulator 106 to a subcritical level such as 500 psig. 500 psig is chosen as a convenient value which is subcritical (below 547 psig) for oxygen and nitrogen, and thus other levels may be acceptable depending on the particular cryogen being processed and the process being used. The pressure regulation of the cryogen also introduces some cooling but such cooling is incidental. The prime requirement is that the cryogen be at a subcritical pressure before the next step in the process.

Figure 19A:
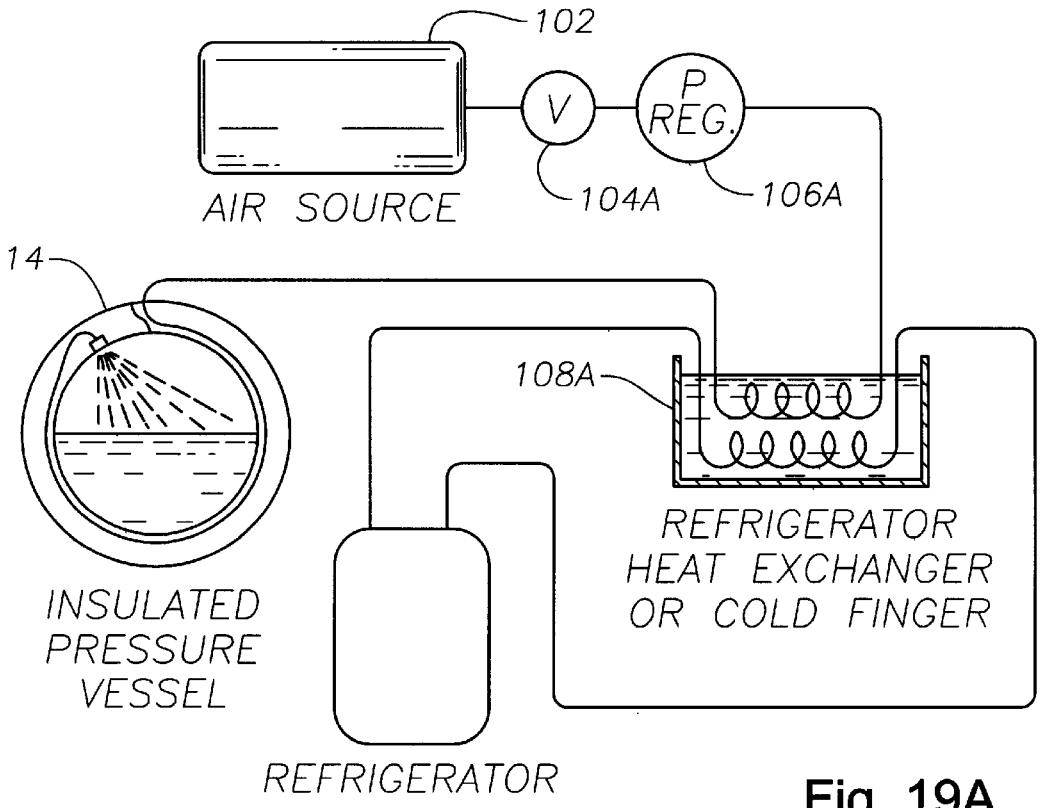
FIG. 19A is a diagrammatic view, partly in section, illustrating another embodiment of the improved process.
Figure 19B:
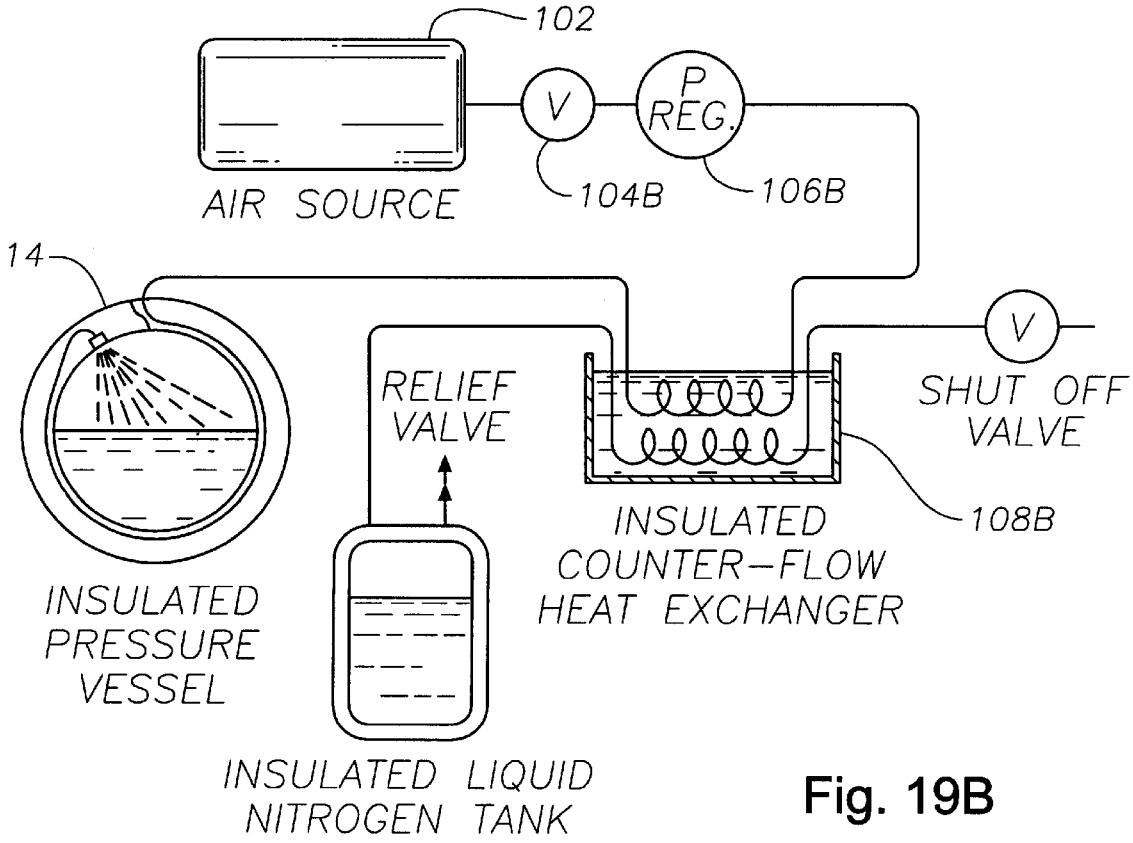
FIG. 19B is a diagrammatic view, partly in section, illustrating a still further embodiment of the improved process.

The cryogen is then cooled to a subcritical temperature. The preferred embodiment illustrated in FIG. 19 employs liquid nitrogen bath 108 in which heat exchanger coil 110 is immersed. However, as shown in FIGS. 19A and 19B, respectively a helium closed-cycle refrigerator or a liquid nitrogen counter-flow heat exchanger (as well as several other alternatives known to the art) may also be employed. Furthermore, liquid argon may be substituted for the liquid nitrogen in bath 108 with corresponding adjustments to the temperature of bath 108. The temperature of the liquid nitrogen in bath 108 is maintained at approximately 77K (the boiling point of nitrogen at atmospheric pressure). In the preferred embodiment, the air is cooled to approximately 77K. The general rule for this step is that cooler is better, although care must be taken to avoid cooling the cryogen to the point of solidification. Once the cryogen is cooled to a subcritical temperature, it is a true liquid at subcritical temperature and pressure. The illustrated parts of the systems of FIGS. 19A and 19B which are common to those of FIG. 19 been corresponding reference characters with the suffixes "A" and "B".

The subcritical liquid enters the liquid cryogen supply and delivery means (i.e., fill lines 39 and/or 40 seen in FIG. 2) of dewar 10 as a cryogen under a pressure gradient and then enters pressure vessel 12 of dewar 10 via respective openings in the side wall of the vessel to which the fill lines are sealably connected. The pressurized liquid cryogen fills pressure vessel 12 rapidly and hence promotes the rapid fill of dewar 10, which is indicated when the liquid begins entering the open end of second conduit 54.

Gas supplying and venting means 42 is equipped with a relief valve not shown to prevent the contents of dewar 10 from over-pressure conditions. The relief valve vents gas when the content pressure exceeds approximately 40 psig, which is also the operating pressure of dewar 10. In the event the contents of dewar 10 are below operating pressure, the contents may be pressurized via gas supplying and venting means 42 as described above.

It is therefore evident that the invention claimed herein may be embodied in alternative and equally satisfactory embodiments without departing from the spirit or essential characteristics thereof. Those of ordinary skill in the art having the benefits of the teachings herein will quickly realize beneficial variations and modifications on the preferred embodiments disclosed herein such as that discussed in the above paragraph, all of which are intended to be within the scope of the invention. The preferred embodiments must consequently be considered illustrative and not limiting of the scope of the invention.

From the foregoing it will be seen that this invention is one well adapted to attain all of the ends and objects hereinabove set forth, together with other advantages which are obvious and which are inherent to the apparatus.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

What is claimed is:

1. Apparatus for storing and delivering liquid cryogen, comprising:

an insulated vessel having spaced end walls and a side wall extending between the end walls, the side wall being of such shape as to define a circle within a plane perpendicular to a first axis of the vessel and being arcuate about a second axis of the vessel lying in the plane;

first means for supplying and delivering liquid cryogen to and from the vessel including a first conduit mounted in the vessel for rotation about the first axis as well as rotation about the second axis and being of such length that its open end closely circumscribes the inner surface of the side wall and sweeps closely past the arcuate inner surface of the side wall from one end wall to the other, as the orientation of the vessel changes, second means through which a gas may be supplied to or exhausted from the vessel above the level of the liquid cryogen, and means connecting the first conduit with the exterior of the vessel in such a manner that liquid cryogen may be supplied to or exhausted from the first conduit in any orientational positions of the vessel, the rotation of the first conduit permitting substantially all of the liquid cryogen in the vessel to be exhausted therefrom.

2. As in claim 1, wherein said second means includes a second conduit mounted in the vessel for rotation about the first axis with its open end generally opposed to the end of the first conduit.

3. As in 2, wherein the second conduit is mounted in the vessel for rotation about the second axis as well as the first axis.

4. As in claims 1 or 2, wherein the first conduit has an inner member extending from the connecting means within the vessel for rotation about the first axis and an outer member in which the open end is formed and pivotally connected to the inner member for rotation about the second axis to immerse the open end in the liquid cryogen.

5. As in claim 4, wherein the inner surfaces of the end walls are respectively concave and convex.

6. As in claims 1 or 2, wherein the first and second axes intersect, and the inner surface of the side wall is of spherical shape about a first center lying within the first axis.

7. As in claim 6, wherein the end walls are of spherical shape about centers which lie within the first axis on opposite sides of the first center.

8. As in 7, further including means for mounting the vessel within an outer housing and minimizing the amount of heat transferred between the housing and the vessel.

9. As in 8, wherein the mounting means includes a pair of reinforcing rings for closely fitting about the respective reinforcing rings, and a plurality of spokes extending radially inwardly from each of the reinforcing rings and converging at outer hubs supported in the outer housing walls, whereby the conductive heat transfer path is limited to the interface of the hubs with the outer housing walls.

10. As in claim 1, wherein the connecting means includes a central hub supported by the end walls for rotation about the first axis and on which the first conduit is mounted for rotation therewith, the hub having passages for connecting the first conduit with the exterior of the vessel.

11. As in claim 10, wherein the second means includes a second conduit which is also mounted on the hub for rotation therewith with its open end generally opposed to the end of the first conduit, and the hub passages also connect the second conduit with the exterior of the vessel.

12. As in 11, further comprising means for offsetting the center of mass of a rotating assembly including the hub and the first and second conduits to prevent the rotating assembly from achieving a stable position, whereby the first conduit is free to move with the liquid cryogen as the orientation of the vessel changes.

13. As in claim 12, wherein kicker means including a plurality of arms mounted to the hub and arranged as a right triangle with a hypotenuse arm that extends between a first end adjacent the intersection of the second axis and the inner surface of the side wall and a second end positioned generally along a third axis orthogonal to the first and second axes, means for restraining the first conduit to rotate about the first axis with the kicker means, and a weight slidable along the hypotenuse arm between its first and second ends in response to an external force acting on the weight.

14. As in 13, wherein the hypotenuse arm is hollow and weighted objects are contained therein for rolling therethrough between the first and second ends of the arm to further induce the open end of the first conduit to follow the liquid cryogen in the vessel.

15. As in claim 11, including a capacitance gauge for measuring the liquid cryogen content within said vessel mounted for rotation with the hub about the first axis.

16. As in claim 15, wherein the capacitance gauge comprises a first electrically conductive plate having outer edges conforming with the inner surfaces of the vessel, a second electrically conductive plate having outer edges conforming with the inner surfaces of the vessel and electrically isolated from but fastened to the first plate with a small gap between the plates, and electrical leads communicating electrical signals to the exterior of the vessel that are indicative of the liquid cryogen content within the vessel.

17. As in 16, including a kicker comprising a plurality of arms mounted to the hub and the capacitance gauge and arranged as a right triangle with a hypotenuse arm that extends between a first end adjacent the intersection of the second axis and the inner surface of the side wall and a second end generally along a third axis orthogonal to the first and second axes, means mounted to the capacitance gauge for inducing the first conduit to rotate about the first axis with the kicker, and a weight slidable along the hypotenuse arm between its first and second ends in response to an external force acting on the weight.

18. As in 17, wherein the rotation inducing means includes a bracket extending between the sides near an end of one of the plates to form a lateral guideway through which the end of the first conduit extends permitting the first conduit to slide across the plate from one end wall to the other.

19. As in claim 11, wherein the hub has axles on each side thereof rotatably mounted in bearings supported in the end walls, each bearing having a passage therethrough connecting with a passage in the hub to connect with outer openings in the vessel exterior, the passages in the hub comprising a through port connecting with one of the bearing passages, and a lateral port connecting the inner end of each of the respective conduits with the through port.

20. As in 19, wherein each conduit has a rigid outer portion and a flexible inner portion connecting the inner end of the conduit to one of the lateral ports, a longitudinal brace connects the rigid outer portions of the conduits for rotation with one another, and the hub includes slots therein diverging from the center thereof to accommodate pivoting of the conduits.

21. As in 20, wherein the brace extends through the slots which accommodate pivoting of the brace as the first conduit is rotated about the second axis by an external force acting thereon.

22. As in 11, wherein the hub includes a pair of hollow axles each rotatably mounted in a bearing means supported in the end walls, and a bellows positioned about one of the respective axles and having an annular face seal at one end of the bellows engaging an annular outer face of the one respective bearing means about the one axle to provide a rotating seal assembly between the hub and the one bearing means.

23. As in 22, wherein the hub further includes a metal diaphragm for sealing the interface between the end walls and the bearing means.

24. As in 23, including a pair of outer tubes each extending through an opening in the end wall and connected to an opening in the bearing housing for communicating the liquid cryogen and the gas, respectively, between the vessel and the exterior of the vessel.

25. As in 24, wherein each bearing means includes a rotary joint for communicating an electrical signal from at least one of the plates of the capacitance gauge through at least one of the outer tubes for indicating the level of liquid cryogen in the vessel.

26. As in 25, wherein the rotary joint includes an electrical pickup mounted in at least one of the bearing means and in which the end of at least one of the axles is supported for rotation, the axles being electrically conductive and wired to the plates of the capacitance gauge and the one electrical pickup being wired to the exterior of the vessel through one of the outer tubes, whereby an electrical signal is communicated from the plates to the exterior of the vessel.

27. As in 1, further comprising means for preventing the first conduit from achieving a stable position, whereby the first conduit is free to move with the liquid cryogen as the orientation of the vessel changes.

28. As in claim 27, wherein the preventing means includes means including a pair of arms mounted for rotation with the first conduit and disposed generally within said first plane, a first of the arms extending generally radially from the first axis along the second axis, and a second of the arms extending diagonally from near the side wall of the vessel to intersect at its outer end with the outer end of the first arm, and a weight slidable along the first arm from its inner end toward its outer end, in response to rotation of the first arm out of said plane.

29. As in 28, wherein the first arm is hollow and weighted objects are contained therein for sliding therein from one end to the other to further induce rotation, contained therein for rolling therethrough between the first and second ends of the arm to further induce the open end of the first conduit to follow the liquid cryogen in the vessel.

30. A system for filling an insulated pressure vessel with liquid cryogen, wherein the vessel includes means for venting gas therefrom to prevent overpressurization of the vessel, said system comprising:

a source of pressurized gas means for regulating the gas below supercritical pressure;

means for cooling the gas to a subcritical temperature at a subcritical pressure to obtain a cryogenic fluid; and means for delivering the cryogenic fluid to the pressure vessel.

31. The system of claim 30, wherein said cooling means includes means for passing the gas through a heat exchange coil immersed in a liquid nitrogen bath.

32. The system of claim 30, wherein said cooling means includes means for passing the gas through a heat exchange coil immersed in a closed cycle helium refrigerator.

33. The system of claim 30, wherein said cooling means include means for passing gas through a counter-flow liquid nitrogen heat exchanger.

34. A process for filling an insulated pressure vessel with liquid cryogen, comprising the steps of:

cooling a gas received at a pressure below supercritical pressure and at ambient temperature to subcritical pressure and temperature to produce a cryogenic fluid;

delivering the cryogenic fluid to the pressure vessel; and selectively venting gas from the pressure vessel to prevent overpressurization of the pressure vessel.

35. The process of claim 34, wherein the gas is subcritically cooled by passing the gas through a heat exchange coil immersed in a liquid nitrogen bath.

36. The process of claim 34, wherein the gas is subcritically cooled by passing the gas through a closed cycle helium refrigerator.

37. The process of claim 34, wherein the gas is subcritically cooled by passing the gas through a counter-flow liquid nitrogen heat exchanger.

* * * * *